US006225749B1

(12) United States Patent
Kobayashi et al.

(10) Patent No.: US 6,225,749 B1
(45) Date of Patent: May 1, 2001

(54) METHOD OF DRIVING ELECTRON-EMITTING DEVICE, METHOD OF DRIVING ELECTRON SOURCE USING THE ELECTRON-EMITTING DEVICE, AND METHOD OF DRIVING IMAGE FORMING APPARATUS USING THE ELECTRON SOURCE

(75) Inventors: Tamaki Kobayashi, Isehara; Noritake Suzuki, Atsugi, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,945

(22) Filed: Sep. 14, 1999

(30) Foreign Application Priority Data

Sep. 16, 1998 (JP) ..... 10-261831
Sep. 7, 1999 (JP) ..... 11-253492

(51) Int. Cl.[7] ..... G09G 3/10

(52) U.S. Cl. ..... 315/169.3; 345/77; 345/211

(58) Field of Search ..... 315/169.1, 169.2, 315/169.3, 169.4, 168, 150; 345/77, 74, 208, 211, 214

(56) References Cited

U.S. PATENT DOCUMENTS

| | | | | |
|---|---|---|---|---|
| 4,894,611 | * | 1/1990 | Shimoda et al. | 324/158 R |
| 5,025,196 | * | 6/1991 | Suzuki et al. | 315/168 |
| 5,136,212 | * | 8/1992 | Eguchi et al. | 315/150 |
| 5,155,416 | * | 10/1992 | Suzuki et al. | 315/169.3 |
| 5,262,698 | * | 11/1993 | Dunham | 315/169.1 |
| 5,659,328 | * | 8/1997 | Todokoro et al. | 345/74 |
| 5,936,342 | * | 8/1999 | Ono et al. | 313/495 |
| 5,998,924 | * | 12/1999 | Yamamoto et al. | 315/169.4 |
| 6,017,259 | | 1/2000 | Motoi et al. | 445/51 |

FOREIGN PATENT DOCUMENTS

| | | |
|---|---|---|
| 0701265A1 | 3/1996 | (EP) . |
| 0746008A1 | 12/1996 | (EP) . |
| 1-292728 | 11/1989 | (JP) . |
| 6-289813 | 10/1994 | (JP) . |
| 6-289814 | 10/1994 | (JP) . |
| 8-096700 | 4/1996 | (JP) . |
| 08264112 | 10/1996 | (JP) . |
| 8-264112 | 10/1996 | (JP) . |
| 2598301 | 1/1997 | (JP) . |
| 9-050256 | 2/1997 | (JP) . |
| 9-199006 | 7/1997 | (JP) . |
| 2836015 | 10/1998 | (JP) . |

OTHER PUBLICATIONS

Hisashi Araki, et al., "Electroforming And Electron Emission Of Carbon Thin Films," *Journal of the Vacuum Society of Japan*, vol. 26, No. 1, Sep. 24, 1981.

M. I. Elinson, et al., "The Emission of Hot Electrons And The Field Emission Of Electrons From Tin Oxide," *Radio Engineering and Electronic Physics*, Jul., 1965.

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

An emission current (Ie1) emitted by the electron-emitting device and/or a device current (If1) flowing through the electron-emitting device are measured when a voltage (V1) is applied to the electron-emitting device and an emission current (Ie2) emitted by the electron-emitting device and/or a device current (If2) flowing through the electron-emitting device are measured when the voltage (V1) is applied to the electron-emitting device after the measurement step. A voltage (V2) higher than the voltage (V1) is applied to the electron-emitting device when the emission current (Ie2) is larger than the emission current (Ie1) and/or the device current (If2) is larger than the device current (If1).

10 Claims, 27 Drawing Sheets

METHOD OF DRIVING ELECTRON-EMITTING DEVICE, METHOD OF DRIVING ELECTRON SOURCE USING THE ELECTRON-EMITTING DEVICE, AND METHOD OF DRIVING IMAGE FORMING APPARATUS USING THE ELECTRON SOURCE

BACKGROUND OF THE INVENTION

1. Field of the Invention

The present invention relates to a flat panel display and, more particularly, to a method of driving an electron-emitting device, a method of driving an electron source formed by arranging a plurality of electron-emitting devices, and a method of driving an image forming apparatus using the electron source.

2. Description of the Related Art

Conventionally, two types of devices, namely thermionic cathode and cold cathode, are known as electron-emitting devices. Known examples of the cold cathodes are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965).

The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an $SnO_2$ thin film according to Elinson, and in addition a carbon thin film [Hisashi Araki et al., "Vacuum", Vol. 26, No. 1, p. 22 (1983)], and the like.

Further, a surface-conduction emission type electron-emitting device using a coated carbon film is disclosed in Japanese Patent No. 02836015.

Since these devices have a simple structure and can be easily manufactured, many devices can be formed on a wide area.

On the other hand, flat panel displays using liquid crystals have recently replacing CRTs. However, LCD is not of a emissive type, and must be equipped with a backlight. Demands arise for development of emissive type display apparatuses. An example of the emissive type display apparatuses is an image forming apparatus as a display apparatus using a combination of an electron source formed by arranging a large number of surface-conduction type electron-emitting devices and a fluorescent substance which emits visible light upon reception of electrons emitted by the electron source.

An example of the device using a coated carbon film is shown in FIGS. 20A and 20B.

In FIGS. 20A and 20B, reference numeral 1 denotes a substrate; 2 and 3, electrodes; 4, a conductive film; 6, a first gap; 7, a second gap; and 10, a carbon film.

An example of a method of forming the device using a coated carbon film is shown in FIGS. 21A to 21D.

The electrodes 2 and 3 are formed on the substrate 1 (FIG. 21A). The conductive film 4 for connecting the electrodes 2 and 3 is formed (FIG. 21B). A current is flowed through the conductive film 4 to form the first gap 6 at part of the conductive film (this will be called a forming step) (FIG. 21C).

A voltage is applied across the electrodes 2 and 3 in, e.g., an organic substance atmosphere to form the carbon film 10 (FIG. 21D). Simultaneously when the carbon film 10 is formed, the second gap 7 is formed. By this step, the second gap 7 narrower than the first gap 6 can be formed. A portion around the second gap 7 is called an electron-emitting portion 5.

The carbon film contains carbon, and/or a carbon compound.

The step of forming the gap 7 narrower than the first gap 6 formed in the forming step, and improving electron-emitting characteristics will be called an activation step.

If satisfactory electron-emitting characteristics can be obtained by the gap 6 formed in the forming step, the activation step need not always be performed. However, the activation step is preferably performed in terms of the stability of electron-emitting characteristics and the selectivity of the conductive film material.

The device having the gaps formed in these steps preferably undergoes a step called a stabilization step. In this stabilization step, e.g., the device and a device housing are heated to remove/discharge an organic substance present in the device atmosphere so as not to deposit new carbon or carbon compound.

The electron-emitting device formed in the above steps is driven as follows.

That is, a device voltage (Vf) is applied across the electrodes 2 and 3 in a low-pressure atmosphere formed in the stabilization step. At the same time, an anode voltage (Va) is applied to the anode electrode arranged above the device. A current flowing between the electrodes 2 and 3 upon applying the voltage Vf across the electrodes 2 and 3 will be called a device current If, and a current flowing from the device into the anode electrode will be called an emission current Ie.

The device attains a device characteristic (relationship of Ie and If to Vf) as shown in FIG. 6, although the characteristic changes depending on measurement conditions. Note that Vth in FIG. 6 represents a device voltage from which Ie can be monitored.

Japanese Patent Laid-Open No. 8-96700 discloses that the device after the stabilization step maintains the characteristic (memory property) of uniquely determining the emission current Ie and device current If depending on the maximum voltage value (Vmax) of the device voltage Vf applied during the manufacture and driving.

According to this reference, when a device voltage applied at given time exceeds the maximum value (Vmax) of the device voltage Vf applied before, the relationship (device characteristic) of Ie and If to Vf changes. More specifically, the device characteristic characterized by Vmax changes to one characterized by a voltage higher than Vmax (Vmax dependence).

According to this reference, this characteristic (memory property and Vmax dependence) is used to correct variations in device characteristics after the stabilization step.

However, it is difficult to maintain the atmosphere formed in the stabilization step and to form an atmosphere desired in the stabilization step.

For this reason, if the organic substance cannot be satisfactorily removed in the stabilization step, the following problems ① and ② may occur.

Problem ①

If the device is driven for a long time after the stabilization step, the device characteristic which should be characterized by the maximum voltage value (Vmax) may vary, i.e., the memory property may be lost. In addition, the device current If and emission current Ie become unstable.

This phenomenon is presumed to arise from structural changes near the gap owing to new carbon or carbon compound deposited near the gap 6 or 7.

As a detailed phenomenon of the problem ①, while the device is driven by a voltage value V1 lower than the maximum voltage value (Vmax), the device characteristic gradually shifts to one (device current characteristic or emission current characteristic with respect to the device voltage) characterized by the voltage value V1. More specifically, the device current If and emission current Ie vs. device voltage Vf curves shown in FIG. 6 shift to the left.

As a result, even if the device is driven by the same device voltage value Vf, the device current If and emission current Ie increase.

This phenomenon becomes more serious in an electron source in which a plurality of devices are connected to a common wiring. The wiring connected to a plurality of devices has a given resistance value, and each device has a characteristic of flowing the device current If. If one device A among the commonly connected devices varies in characteristic (particularly increases If), an effective device voltage applied to an adjacent device B decreases. Considering the phenomenon ①, a decrease in effective device voltage Vf applied to the device B makes characteristic variations in device B larger than characteristic variations in device A. In this manner, when devices are commonly connected, the characteristics of the respective devices successively vary.

Problem ②

If the device is kept driven by the maximum voltage value (Vmax), the device current If and emission current Ie remarkably decrease.

One reason of the phenomenon ② is presumed to be structural changes near the gap 6 or 7 owing to driving heat or a residual organic substance gas which cannot be removed in the stabilization step.

A method for improving variations in device characteristics supposed to arise from the device atmosphere is disclosed in, e.g., Japanese Patent Laid-Open Nos. 9-50256, 6-289813, 6-289814, and 9-199006, and Japanese Patent No. 2598301.

From the phenomena ① and ②, the maximum voltage value (Vmax) may-be periodically applied at a predetermined interval during driving at the voltage value V1 so as to maintain the device characteristic characterized by the maximum voltage value (Vmax).

In this case, however, the maximum voltage value (Vmax) maybe unnecessarily applied. For example, in a flat panel display using an electron source formed by arranging many devices, a display video image always changes, and the driving conditions and frequency change between the devices. When the maximum voltage value (Vmax) is periodically applied to all the devices at a predetermined interval, it is undesirably applied to a device which does not vary in characteristic or exhibits only a small degree of variation.

In this case as well as the case ②, the device current If and emission current Ie may greatly change during long-time driving.

By applying the maximum voltage value (Vmax), increases in device current and emission current with respect to a predetermined driving voltage value (Vf) can be suppressed. However, the device characteristic may greatly deteriorate due to an unnecessarily long application time of the maximum voltage value (Vmax) in a device which does not vary in characteristic or exhibits only a small degree of variation.

SUMMARY OF THE INVENTION

The present invention has been made to eliminate the problems ① and ②, and has as its object to provide a method of driving an electron-emitting device which hardly varies and deteriorates in electron-emitting characteristics, a method of driving an electron source using the electron-emitting device, and a method of driving an image forming apparatus using the electron source.

To achieve the above object, a method of driving an electron source according to the present invention comprises the following steps.

That is, there is provided a method of driving an electron-emitting device, comprising A) the first measurement step of measuring an emission current amount (Ie1) emitted by the electron-emitting device and/or a device current amount (If1) flowing through the electron-emitting device when a voltage (V1) is applied to the electron-emitting device, B) the second measurement step of measuring a current amount (Ie2) emitted by the electron-emitting device and/or a device current amount (If2) flowing through the electron-emitting device when the voltage (V1) is applied to the electron-emitting device after the first measurement step, and C) the voltage application step of applying a voltage (V2) higher than the voltage (V1) to the electron-emitting device when the current amount (Ie2) is larger than the emission current amount (Ie1) and/or the device current amount (If2) is larger than the device current amount (If1).

According to another aspect of the present invention, there is provided a method of driving an electron-emitting device, comprising:

A) the first measurement step of measuring an emission current amount (Ie1) emitted by the electron-emitting device and/or a device current amount (If1) flowing through the electron-emitting device when a pulse-like voltage is applied to the electron-emitting device;

B) the second measurement step of measuring a current amount (Ie2) emitted by the electron-emitting device and/or a device current amount (If2) flowing through the electron-emitting device when the same waveform as a waveform of the pulse-like voltage is applied to the electron-emitting device after the first measurement step; and C) the voltage application step of applying to the electron-emitting device a pulse-like voltage having a power larger than a power (integrated value of a voltage value by a time) of the pulse applied in the first measurement step when the current amount (Ie2) is larger than the emission current amount (Ie1) and/or the device current amount (If2) is larger than device current amount (If1).

According to the present invention, the first measurement step, second measurement step, and voltage application step are repeated after the voltage application step is performed.

According to the present invention, the voltage (V2) is not higher than a maximum voltage value (Vmax) applied to the electron-emitting device before the first measurement step.

According to the present invention, the voltage applied to the electron-emitting device is a pulse-like voltage.

According to the present invention, a power of a pulse applied in the voltage application step is not larger than a maximum power applied to the electron-emitting device before the first measurement step.

According to the present invention, there is provided a method of driving an electron source obtained by arranging a plurality of electron-emitting devices, wherein the electron-emitting devices are driven by the method of driving the electron-emitting device.

According to the present invention, there is provided a method of driving an image forming apparatus comprising an electron source and image forming member, wherein the electron source is driven by the method of driving the electron source.

The above-described driving method of the present invention can provide an electron-emitting device, electron source, and image forming apparatus which hardly vary in electron-emitting characteristics and hardly deteriorate even if the device is driven for a long time.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described in detail below with reference to the accompanying drawings.

The basic structures of electron-emitting devices applicable to the present invention can be mainly classified into flat and step electron-emitting devices. First, a flat surface-conduction type electron-emitting device will be described.

Figure 1A:
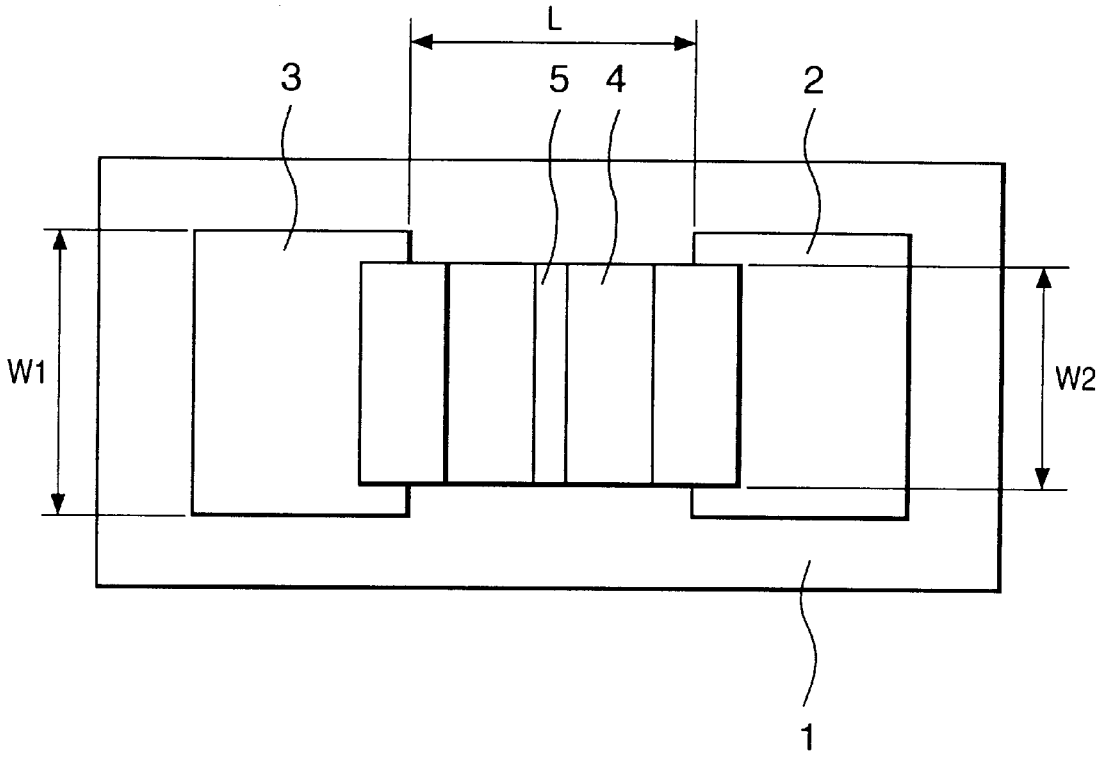
FIGS. 1A and 1B are schematic views showing an example of the structure of an electron-emitting device according to the present invention.
Figure 1B:
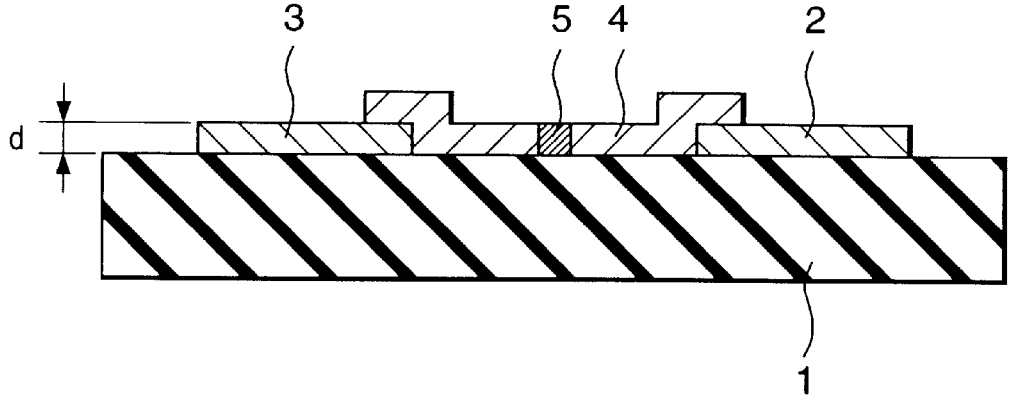

FIGS. 1A and 1B are schematic views showing the structure of a flat electron-emitting device applicable to the present invention, in which FIG. 1A is a plan view, and FIG. 1B is a sectional view.

In FIGS. 1A and 1B, reference numeral 1 denotes a substrate; 2 and 3, electrodes; 4, a conductive film; and 5, an electron-emitting portion. Examples of the substrate 1 are a silica glass substrate, a glass substrate having a low impurity content such as a Na substrate, a soda-lime glass, a glass substrate prepared by stacking an $SiO_2$ layer on a soda-lime glass by sputtering or the like, a ceramics substrate such as an alumina substrate, an Si substrate, and the like.

An example of the material for the facing electrodes 2 and 3 is a general conductive material. The general conductive material includes metals such as Ni, Cr, Au, Mo, W, Pt, Ti, Al, Cu, and Pd, or alloys of these metals, metals such as Pd, Ag, Au, $RuO_2$, and Pd—Ag, a printed conductor made of a metal oxide and glass or the like, a transparent conductor such as $In_2O_3$—$SnO_2$, and a semiconductor material such as polysilicon.

The shape such as an interval L between the electrodes 2 and 3, an electrode width W1, and a width W2 of the conductive film 4 is appropriately designed in consideration of an application purpose or the like. The interval L between the electrodes 2 and 3 can be set within the range from several hundred nm to several hundred μm, and preferably the range from several μm to several ten μm. The width W1 of the electrodes 2 and 3 can be set within the range from several μm to several hundred μm in consideration of the resistance values of the electrodes 2 and 3, and electron-emitting characteristics. A film thickness d of the electrodes 2 and 3 can be set within the range from several ten nm to several μm. Note that the surface-conduction type electron-emitting device is not limited to the structure shown in FIGS. 1A and 1B, and can be constituted by sequentially stacking the conductive film 4 and the facing electrodes 2 and 3 on the substrate 1.

The thickness of the conductive film 4 is properly set in consideration of step coverage for the electrodes 2 and 3, the resistance value between the electrodes 2 and 3, forming conditions (to be described later), and the like. This thickness is set preferably within the range from several multiples of 0.1 nm to several hundred nm, and more preferably within the range from 1 nm to 50 nm. A resistance value Rs is $10^2$ to $10^7$ Ω/□. Note that the resistance value Rs appears when a resistance R of a thin film having a thickness t, width w, and length L is given by R=Rs (L/w).

The present specification will exemplify electrification processing as forming processing, but the forming processing of this embodiment is not limited to this and includes processing of forming a gap 6 in the conductive film 4.

Examples of the material for the conductive film 4 are metals such as Pd, Pt, Ru, Ag, Au, Ti, In, Cu, Cr, Fe, Zn, Sn, Ta, W, and Pb, and oxides such as PdO, $SnO_2$, $In_2O_3$, PbO, and $Sb_2O_3$.

The conductive film 4 is preferably formed from a fine particle film made of fine particles in order to obtain good electron-emitting characteristics.

The fine particle film is one containing a plurality of fine particles. As the fine structure, individual fine particles may be dispersed, be adjacent to each other, or overlap each other (including masses of fine particles forming an island structure as a whole). One fine particle has a diameter within the range from several multiples of 0.1 nm to several hundred nm, and preferably the range from 1 nm to 20 nm.

Note that the present specification often uses the term "fine particle", and this meaning will be explained. A small particle is called a "fine particle", and a smaller one is called an "ultra fine particle". A particle which is smaller than the "ultra fine particle" and contains atoms about several hundred in number is called a "cluster".

However, this classification is not strict and changes depending on a target property. In some cases, both the "fine particle" and "ultra fine particle" are called "fine particles", and the present specification complies with this description.

According to "Experimental Physics 14 Surface.Fine Particle" (K. Kinoshita ed., Kyoritus Shuppan, Sep. 1, 1986), > "In this book, the fine particle means a particle having a diameter from about 2 to 3 μm to about 10 nm. In particular, the ultra fine particle means a particle having a diameter from about 10 nm to about 2 to 3 nm. Both of them may be simply referred to as fine particles, and thus this classification is not strict and is merely a criterion. When the number of atoms forming a particle falls within the range from 2 to about several ten to several hundred, this particle is called a cluster." (lines 22 to 26, p. 195)

In addition, according to the "ultra fine particle" by the "Hayashi, Ultra Fine Particle Project" in Research Development Cooperation of Japan, the lower limit of the particle diameter is defined much lower as follows:

> "In the 'Ultra Fine Particle Project' (1981 to 1986) in Exploratory Research for Advanced Technology, a particle having a size (diameter) within the range from 1 to 100 nm is called an "ultra fine particle". That is, one ultra fine particle is a mass of 100 to 108 atoms. Atomically, the ultra fine particle is a large or enormous particle." (S. Hayashi, R. Ueda, A. Tazaki ed., "Ultra Fine Particles—Advanced Technology—", Mita Shuppan, lines 1 to 4, p. 2, 1988) "A particle which is smaller than the ultra fine particle, i.e., is formed from several to several hundred atoms is generally called a cluster." (11. 12–13, p. 2 in the same reference)

Based on these general terms, the "fine particle" in the present specification indicates one which is a mass of many atoms or molecules and is about several multiples of 0.1 nm to 1 nm in lower limit of the diameter and about several μm in upper limit.

Figure 21A:
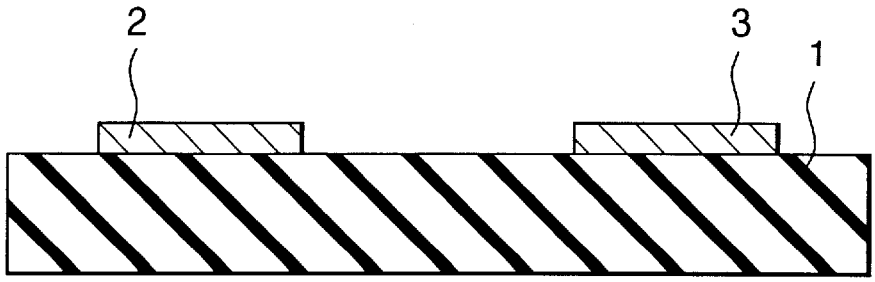
FIGS. 21A to 21D are sectional views, respectively, showing the steps in manufacturing the electron-emitting device having a carbon film.
Figure 21B:
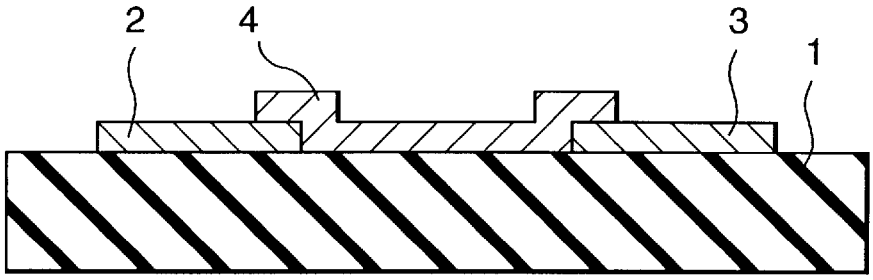
Figure 21C:
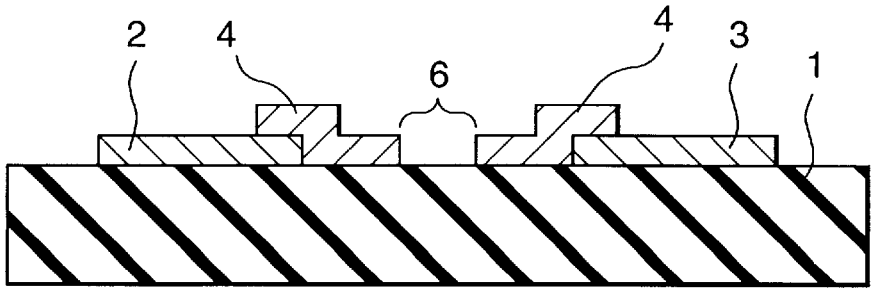
Figure 21D:
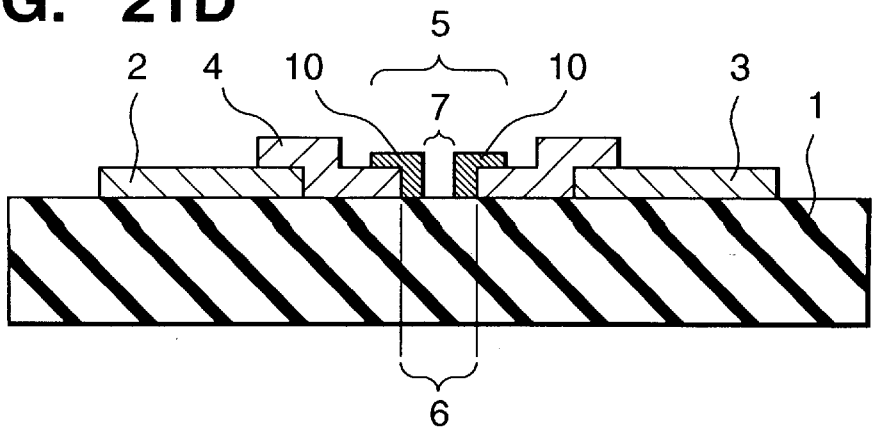

The electron-emitting portion 5 is around the first gap 6 formed at part of the conductive film 4 in a device not requiring the above-mentioned activation step (FIG. 21C). The electron-emitting portion 5 is around a second gap 7 narrower than the first gap 6 formed in the conductive film 4 in a device requiring the activation step (FIG. 21D).

The device to which the driving method of the present invention can be preferably applied is one which emits electrons near the gap 6 or 7 by applying a potential to a pair of conductive films 4 facing each other via the gap 6, or a pair of conductive films (carbon films 10) facing each other via the gap 7, as shown in FIGS. 20A, 20B, and 21A to 21D. That is, the driving method can be preferably applied to a device in which a voltage is applied to a pair of conductive films facing each other via a small (nanometer-scale) gap in vacuum.

Note that FIGS. 1A, 1B, 20A, and 20B schematically show the linear gaps 6 and 7 and electron-emitting portion 5 with uniform widths. In practice, the gap may be zigzagged, or the gap 7 (and/or gap 6) may change in width (interval) at some locations. The gap 7 (and/or gap 6) may include a connecting portion to connect the conductive films 4 or carbon films 10 to each other. However, the connecting portion is very small, and the area including the connected region is called the gap (7 or 6).

The first gap 6 depends on the thickness, quality, and material of the conductive film 4, the method such as forming processing (to be described later), and the like.

The second gap 7 depends on activation conditions (to be described later).

The electron-emitting portion 5 may contain fine conductive particles within the diameter range from several multiples of 0.1 nm to several ten nm. This fine conductive particle contains some or all of the elements of the material for the conductive film 4.

Figure 2:
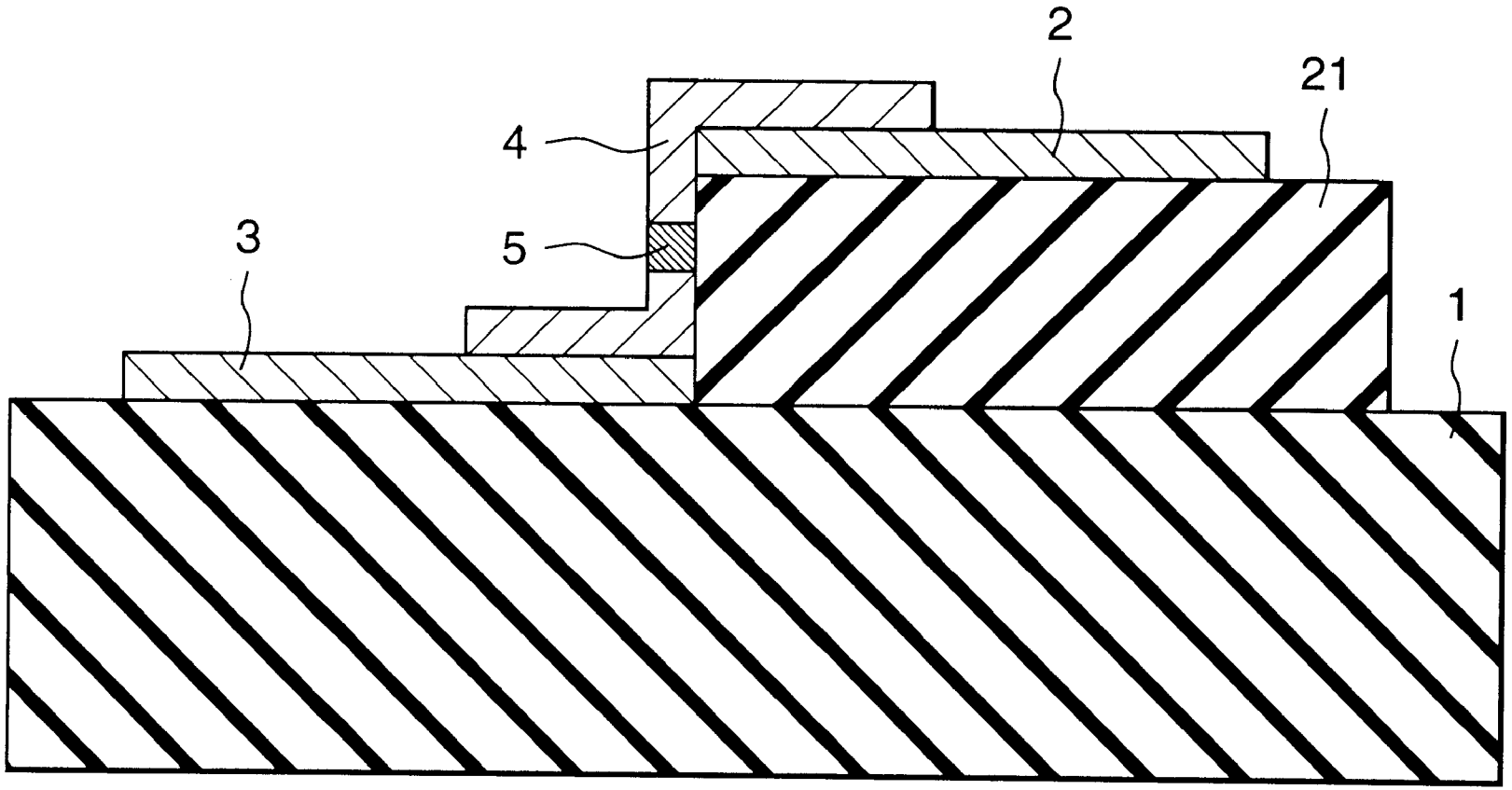
FIG. 2 is a sectional view showing another example of the structure of the electron-emitting device according to the present invention.

Next, a step surface-conduction type electron-emitting device will be described. FIG. 2 is a schematic view showing an example of a step electron-emitting device. In FIG. 2, the same reference numerals as in FIGS. 1A and 1B denote the same parts. The electron-emitting portion 5 is the same as in the flat electron-emitting device, and a description thereof will be omitted.

A substrate 1, electrodes 2 and 3, conductive film 4, and electron-emitting portion 5 can be made of the same materials as in the above-mentioned flat electron-emitting device. The step-forming member 21 can be made of an insulating material such as $SiO_2$ formed by vacuum evaporation, printing, sputtering, and the like. The thickness of the step-forming member 21 corresponds to the electrode interval L of the flat electron-emitting device and can be set within the range from several ten nm to several hundred $\mu$m. This thickness is set in consideration of the manufacturing method of the step-forming member 21 and a voltage applied between the electrodes 2 and 3, and preferably set within the range from several ten nm to several ten $\mu$m.

After the electrodes 2 and 3 and step-forming member 21 are formed, the conductive film 4 is stacked on the electrodes 2 and 3. In FIG. 2, the electron-emitting portion 5 is formed on the side surface of the step-forming member 21. The electron-emitting portion 5 depends on manufacturing conditions, forming conditions, and the like, and its shape and position are not limited to those in FIG. 2.

The electron-emitting device can be manufactured by various methods, and an example of the methods is schematically shown in FIGS. 3A to 3C, and 21A to 21D. An example of the manufacturing method will be explained with reference to FIGS. 1A, 1B, 3A to 3C, 20A, 20B, and 21A to 21D. Also in FIGS. 3A to 3C, the same reference numerals as in FIGS. 1A and 1B denote the same parts.

Figure 3A:
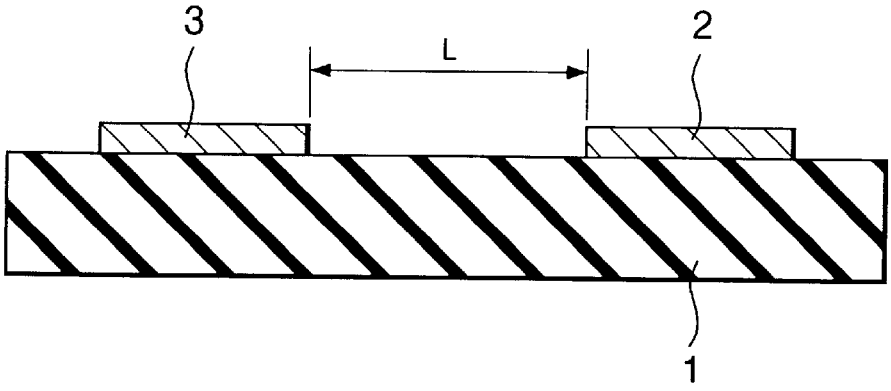
FIGS. 3A to 3C are sectional views, respectively, showing the steps in manufacturing the electron-emitting device according to the present invention.

(1) A substrate 1 is satisfactorily cleaned with a detergent, pure water, organic solvent, and the like, and an electrode material is deposited by vacuum evaporation, sputtering, or the like to form electrodes 2 and 3 on the substrate 1 by, e.g., photolithography (FIGS. 3A and 21A).

Figure 3B:
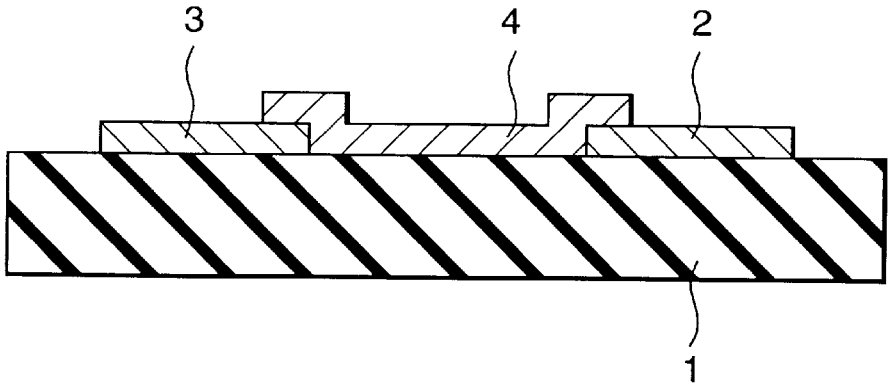

(2) The substrate 1 having the electrodes 2 and 3 is coated with an organic metal solvent to form an organic metal thin film. As the organic metal solvent, an organic metal compound solvent containing a metal of the material for the conductive film 4 as a main device can be used. The organic metal thin film is heated, sintered, and patterned into a conductive film 4 by lift-off, etching, or the like (FIGS. 3B and 21B). Although the coating method of the organic metal solvent has been exemplified, the formation method of the conductive film 4 is not limited to this and can be vacuum evaporation, sputtering, chemical vapor deposition, dispersion coating, dipping, spinner method, or the like.

Figure 3C:
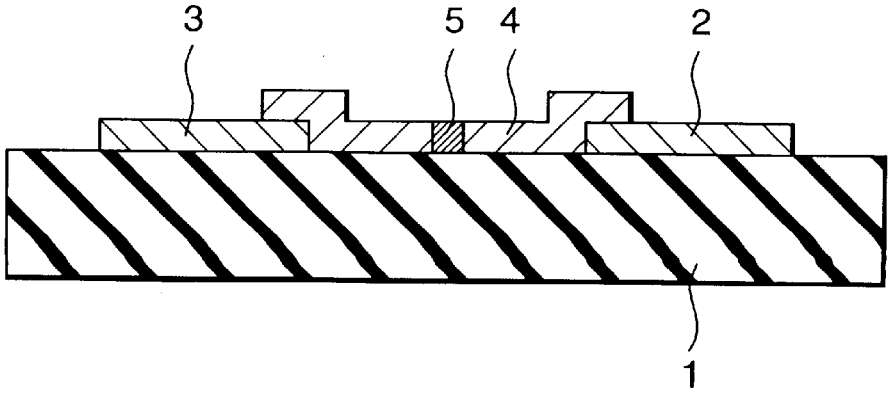

(3) The obtained device is subjected to the forming step. As an example of the forming method, an electrification method will be described. When a current is flowed from a power supply (not shown) through the conductive film 4, an electron-emitting portion 5 is formed at part of the conductive film 4 (FIGS. 3C and 21C).

The electron-emitting portion 5 is formed from the first gap 6 formed at part of the conductive film 4 by the forming step and the vicinity of the first gap 6.

In a device requiring the above-mentioned activation step, the electron-emitting portion 5 is formed by the following activation step.

Figure 4A:
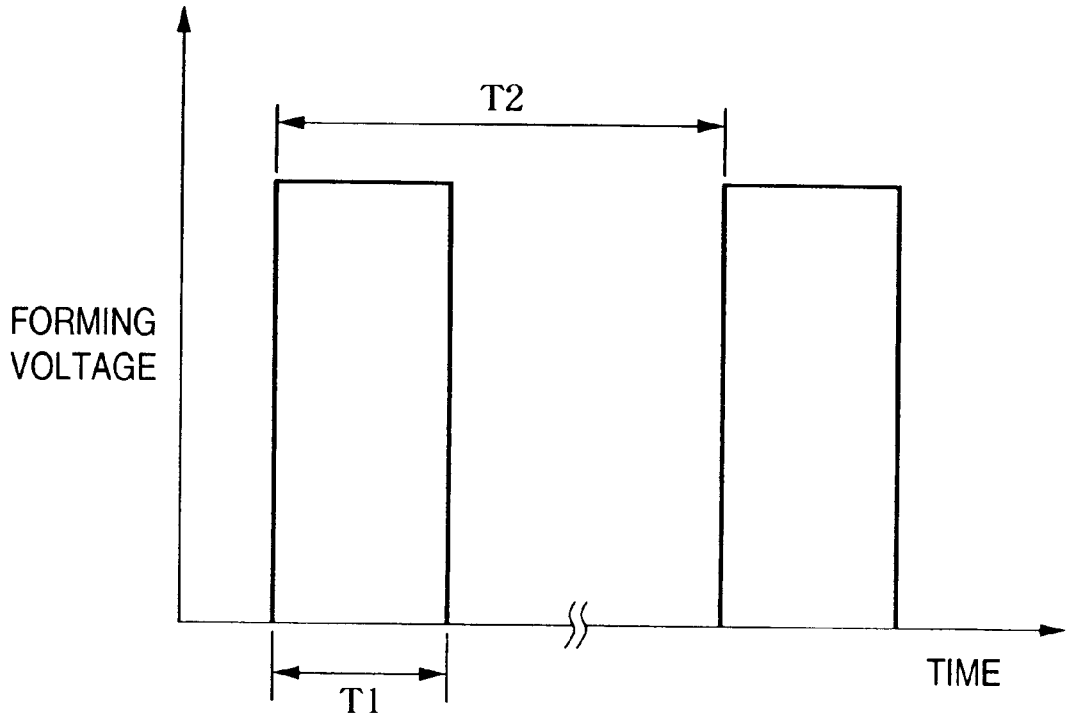
FIGS. 4A and 4B are waveform charts each showing an example of the voltage waveform in forming processing which can be employed in manufacturing the electron-emitting device according to the present invention.
Figure 4B:
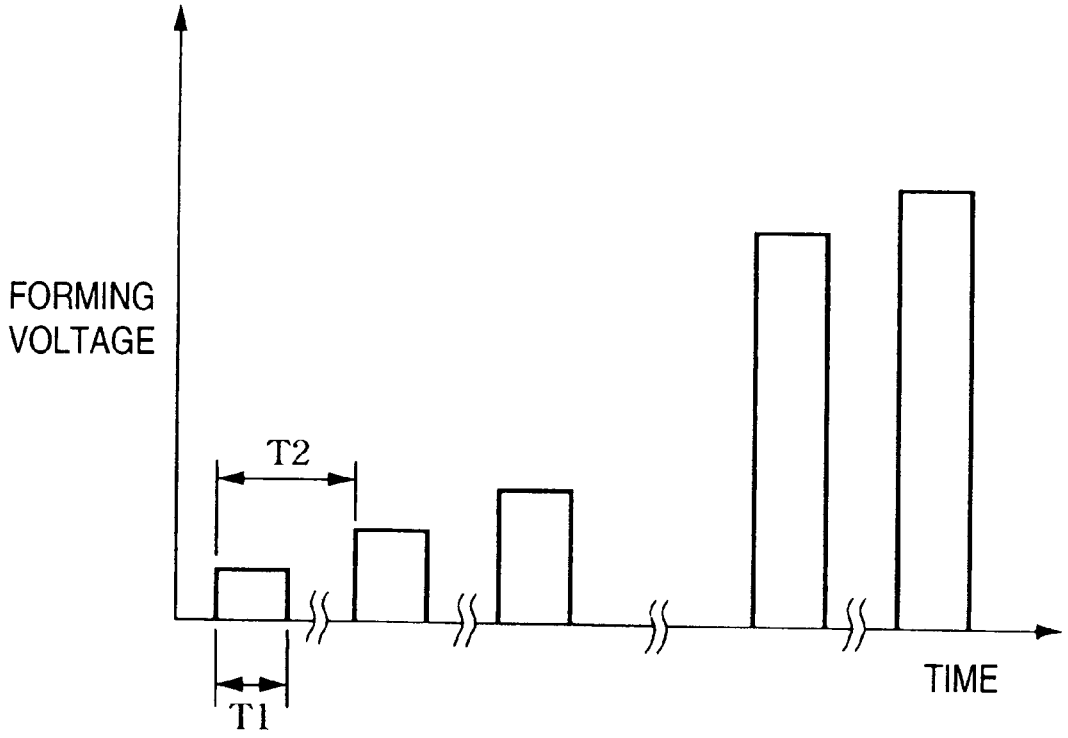

FIGS. 4A and 4B show examples of a forming voltage waveform.

This voltage waveform applied in the forming step is preferably a pulse-like waveform. Pulses can be applied by a method of successively applying pulses whose peak value is a constant voltage, as shown in FIG. 4A, or a method of applying voltage pulses while increasing the pulse peak value, as shown in FIG. 4B.

T1 and T2 in FIGS. 4A and 4B represent the pulse width and pulse interval of the voltage waveform, respectively. In general, T1 is set within the range from 1 $\mu$sec to 10 msec, and T2 is set within the range from 10 $\mu$sec to 100 msec. The peak value of a rectangular wave (peak voltage in forming processing) is appropriately selected in accordance with the shape of the electron-emitting device. Under these conditions, the voltage is applied for, e.g., several sec to several ten min. The pulse waveform is not limited to a rectangular waveform and can be a desired waveform.

T1 and T2 in FIG. 4B can be set equal to those in FIG. 4A. The peak value of the rectangular wave (peak voltage in forming processing) can be increased at, e.g., about 0.1 V/step.

The end of forming processing can be detected by applying such a voltage so as not to locally destruct or deform the conductive thin film 4 during the pulse interval T2 and measuring a device current flowing through the device at this time. For example, a device current flowing upon application of a voltage of about 0.1 V is measured to obtain the resistance value. When this resistance value exhibits 1 MΩ or more, forming processing is completed.

(4) For a device requiring the activation step, the activation step is done. In this step as well as in the forming step, pulses are repeatedly applied in an organic substance gas atmosphere. Note that the voltage value applied to the device in the activation step is desirably higher than the voltage value applied in the forming step.

Figure 22A:
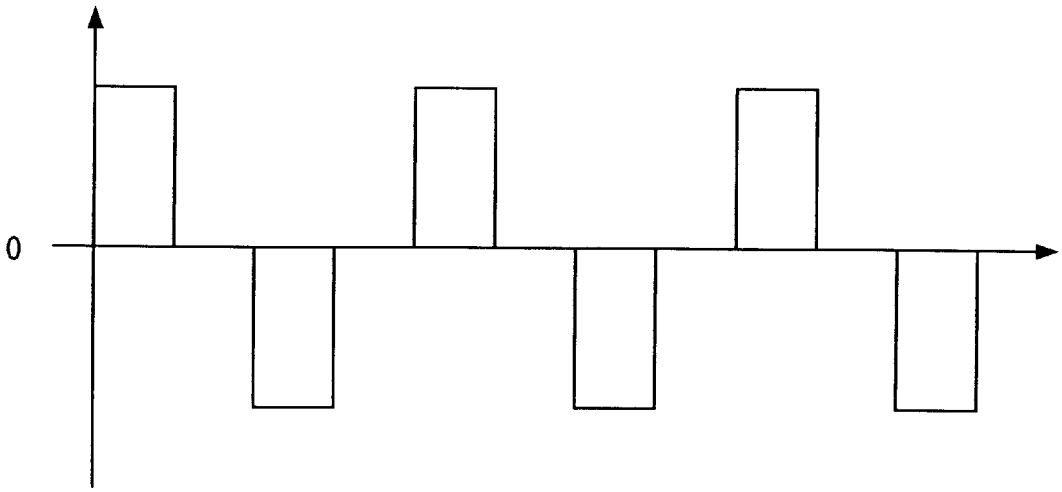
FIGS. 22A and 22B are waveform charts each showing an example of a pulse-like voltage waveform preferably applied to the device in the activation step.
Figure 22B:
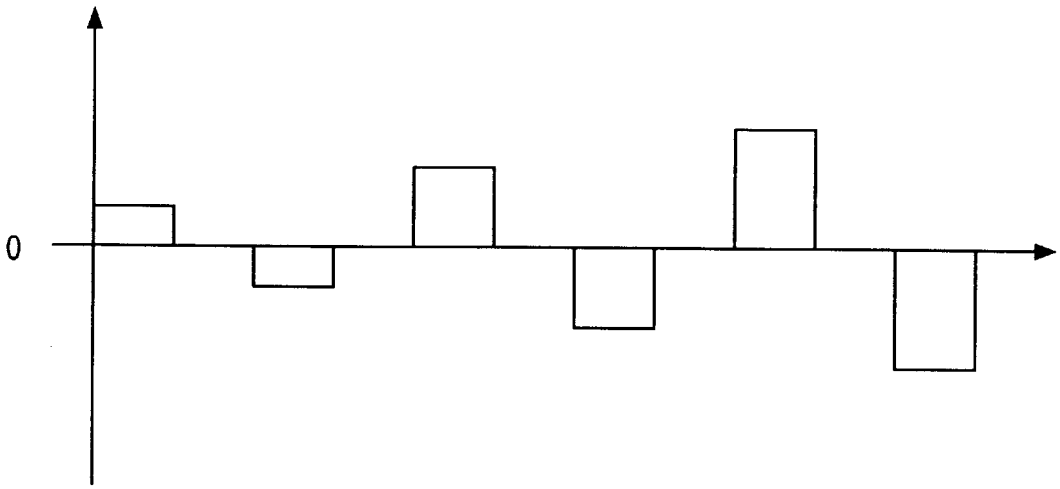

By this step, carbon films 10 are formed inside the first gap 6 and on the conductive film 4. At the same time, a second gap 7 is formed. Further, an electron-emitting portion 5 is formed by this step (FIG. 21D). To form the carbon films 10 substantially symmetrically about the gap 7, the applied pulse waveform must be pulses of two polarities (bipolar pulses), as shown in FIGS. 22A and 22B.

The organic substance gas atmosphere can be formed using an organic gas left in an atmosphere when the vacuum vessel is evacuated with an oil diffusion pump, rotary pump, or the like, or using a proper organic substance gas introduced into a vacuum in the vacuum vessel temporarily sufficiently evacuated by an ion pump or the like. The gas pressure of a preferable organic substance changes depending on the application purpose, the shape of the vacuum vessel, the kind of organic substance, and the like, and thus is appropriately set in accordance with them.

Examples of the proper organic substance are aliphatic hydrocarbons such as alkane, alkene, alkyne, aromatic hydrocarbons, alcohols, aldehydes, ketones, amines, phenol, and organic acids such as carboxylic acid and sulfonic acid. Detailed examples are saturated hydrocarbons given by $C_nH_{2n+2}$ such as methane, ethane, and propane, unsaturated hydrocarbons given by $C_nH_{2n}$ and the like such as ethylene and propylene, benzene, toluene, methanol, ethanol, formaldehyde, acetaldehyde, acetone, methyl ethyl ketone, methyl amine, ethyl amine, phenol, formic acid, acetic acid, propionic acid, and a mixture of these materials. By this processing, an organic substance present in the gas atmosphere forms the carbon film 10 (carbon or a carbon compound) near the first gap 6 to greatly change a device current If and emission current Ie with respect to a predetermined driving voltage. The end of the activation step is determined while measuring the device current If and emission current Ie. Note that the applied pulse width T1, pulse interval T2, pulse peak value, and the like are appropriately set.

Carbon (carbon and/or a carbon compound) produced in this activation step is, e.g., graphite (containing so-called HOPG, PG, or GC; HOPG has an almost perfect graphite crystal structure, PG has a crystal grain size of about 20 nm and a slightly disturbed crystal structure, and GC has a crystal grain size of about 2 nm and a largely disturbed crystal structure.) or amorphous carbon (indicating amorphous carbon and a mixture of amorphous carbon and fine crystals of graphite). The thickness of the carbon film 10 is set preferably within the range of 1 nm to 50 nm, and more preferably within the range of 1 nm to 30 nm.

(5) The electron-emitting device obtained in these steps is desirably subjected to the stabilization step. In the stabilization step, the organic substance in the vacuum vessel is exhausted. An evacuation device for evacuating the vacuum vessel is preferably one not using any oil so as not to affect device characteristics by oil flowing from the evacuation device. More specifically, this evacuation device is a sorption pump, ion pump, or the like.

When an oil diffusion pump or rotary pump is used as the evacuation device in the activation step, and an organic gas produced from the coil component generated from this pump is used, the partial pressure of the component must be minimized. In evacuating the vacuum vessel, the whole vacuum vessel is preferably heated to facilitate exhaustion of organic substance molecules attached to the inner wall of the vacuum vessel and the electron-emitting device. Heating conditions at this time are preferably a temperature of 80 to 250° C. and, more preferably 150° C. or more, and a time as long as possible, but are not particularly limited to them. Heating is performed under conditions properly selected in consideration of various conditions such as the size and shape of the vacuum vessel and the structure of the electron-emitting device. The internal pressure of the vacuum vessel must be minimized to preferably $1\times10^{-5}$ [Pa] or less, and more preferably $1.3\times10^{-6}$ [Pa] or less.

(6) The atmosphere in actual driving after the stabilization step preferably maintains an atmosphere at the end of the stabilization step.

The basic characteristics of the electron-emitting device applicable to this embodiment that is obtained by the above steps will be described with reference to FIGS. 5 and 6.

Figure 5:
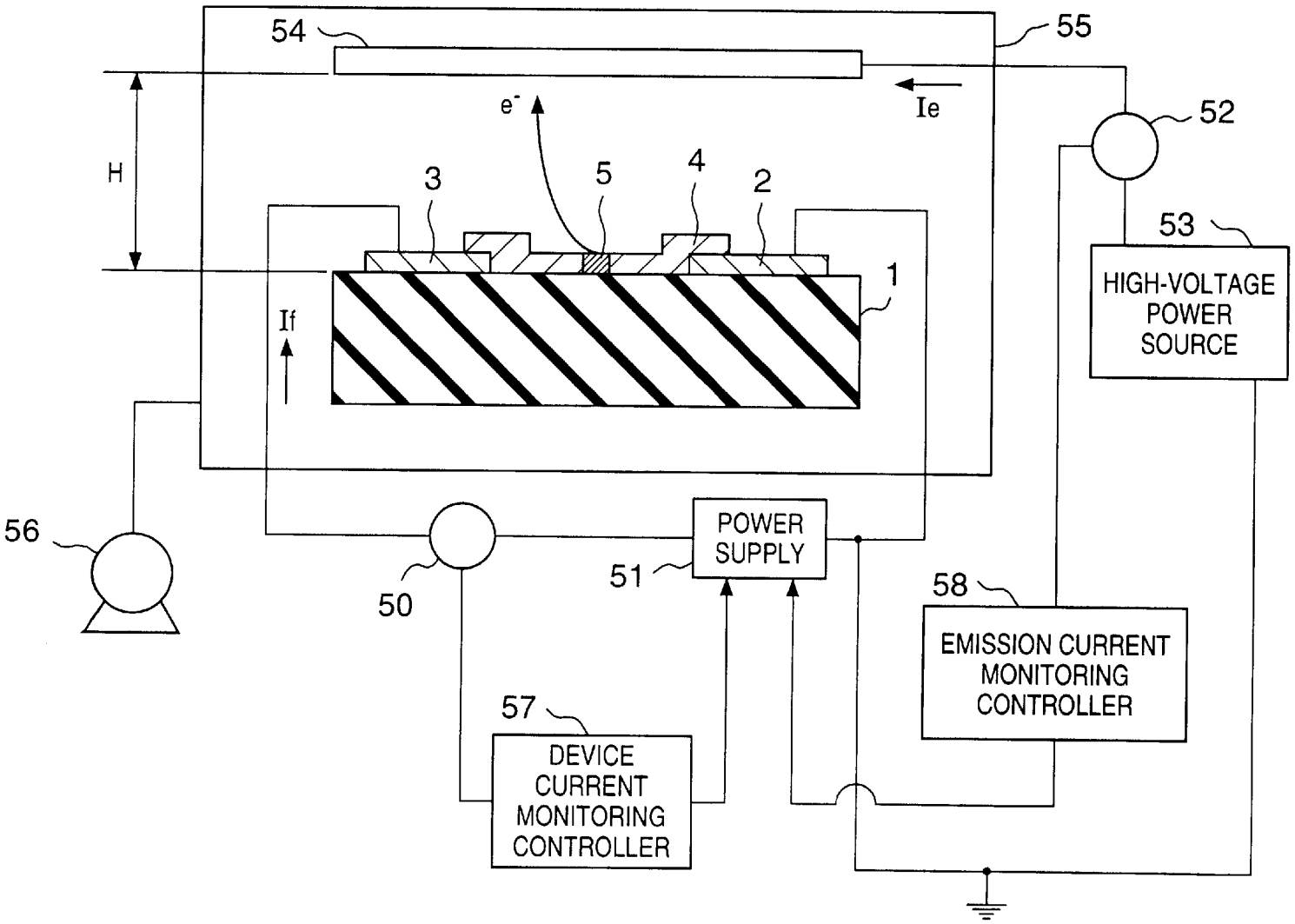
FIG. 5 is a block diagram showing an example of a vacuum processing device having a measurement/evaluation function according to an embodiment.

FIG. 5 is a block diagram showing an example of a vacuum processing device having a function of practicing the electron-emitting device driving method of the present invention and a function of measuring/evaluating device characteristics. The same reference numerals as in FIGS. 1A and 1B denote the same parts, and a description thereof will be omitted.

In FIG. 5, reference numeral 50 denotes an ammeter used to measure the device current flowing through the conductive film 4 between the electrodes 2 and 3; 51, a power supply for applying the voltage between the electrodes of the electron-emitting device; 52, an ammeter for measuring the emission current emitted from the electron-emitting portion 5 of the device; 53, a high-voltage power source for applying the voltage to an anode electrode 54; 54, an anode electrode for capturing electrons emitted from the electron-emitting portion 5 of the device; 55, a vacuum vessel; 56, an exhaust pump; 57, a device current monitoring controller for designating the power supply 51 to change the voltage output from the power supply 51 to a voltage V2 when the ammeter 50 detects an increase in device current; and 58, an emission current monitoring controller for designating the power supply 51 to apply the voltage V2 when the ammeter 52 detects an increase in emission current. For example, the voltage of the anode electrode 54 is set within the range from 1 kV to 10 kV, and a distance H between the anode electrode 54 and electron-emitting device is set within the range from 2 mm to 8 mm. With this setting, the vacuum processing device can perform measurement.

The vacuum vessel 55 incorporates a device (not shown) such as a vacuum gauge necessary for measurement in a vacuum atmosphere to allow measurement and estimation in a desired vacuum atmosphere. The exhaust pump 56 is constituted by a normal high-vacuum device system including a turbo pump and rotary pump and a ultra-high-vacuum device system including an ion pump and the like. The whole vacuum processing device having the electron source substrate shown in FIG. 5 can be heated by a heater (not shown). Using this vacuum processing device, steps subsequent to the above-described forming processing can be performed.

Figure 6:
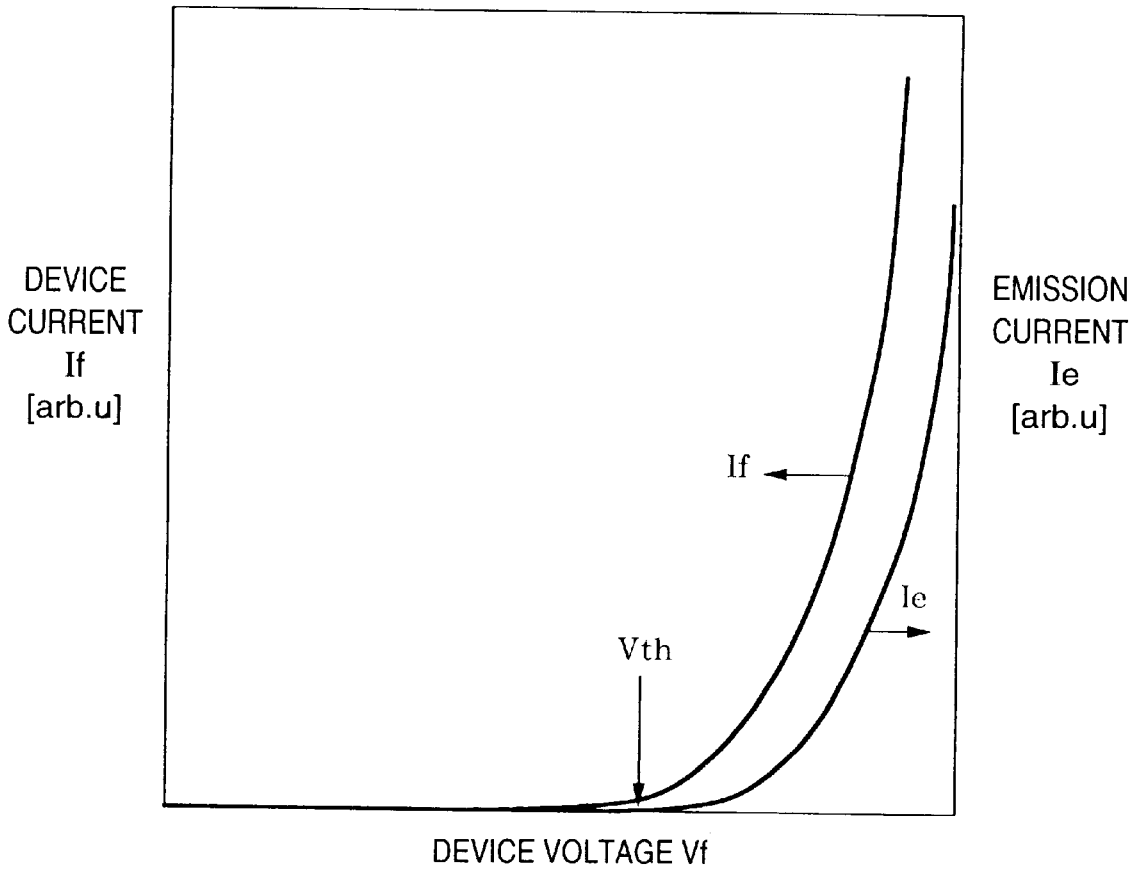
FIG. 6 is a graph showing an example of the relationship between the emission current Ie, device current If, and device voltage Vf in the electron-emitting device according to the present invention.

FIG. 6 is a graph schematically showing the relationship between the emission current Ie, device current If, and device voltage Vf measured using the vacuum processing device shown in FIG. 5. In FIG. 6, since the emission current Ie is much smaller than the device current If, they are given in arbitrary units. In FIG. 6, both the ordinate and abscissa are based on linear scales.

In FIG. 6, the solid line indicates an example (MI characteristic) of monotonically increasing the device current If with respect to the device voltage Vf. To the contrary, the device current If may exhibit a voltage-controlled negative resistance characteristic (VCNR characteristic; not shown) with respect to the device voltage Vf. However, the device characteristic to which the driving method of the embodiment can be adopted is the MI characteristic of monotonically increasing the device current If with respect to the device voltage Vf.

The electron-emitting device of the present invention has three characteristic features regarding the emission current Ie:

(i) The emission current Ie abruptly increases when a device voltage of a predetermined level (threshold voltage: Vth in FIG. 6) or higher is applied, but almost no emission current Ie is detected when the voltage is equal to or lower than the threshold voltage Vth. The device is a nonlinear device with a clear threshold voltage Vth with respect to the emission current Ie.

(ii) The emission current Ie can be controlled by the device voltage Vf because the emission current Ie monotonically increases with respect to the device voltage Vf.

(iii) Emission charges captured by the anode electrode 54 depend on the application time of the device voltage Vf. In other words, a charge amount captured by the anode electrode 54 can be controlled by the application time (pulse width) of the device voltage Vf.

As is apparent from the above description, the electron-emitting characteristics of the electron-emitting device according to the present invention can be easily controlled in accordance with an input signal. By using this property, the electron-emitting device can be applied to various devices such as an electron source constituted by arranging a plurality of electron-emitting devices, and an image forming apparatus.

If exhaustion by the exhaust pump 56 or baking by the heater (not shown) is insufficient in the stabilization step after the activation step or the forming step or the forming step, the organic substance cannot be satisfactorily exhausted. Consequently, as described above, the electron-emitting device changes in electron-emitting characteristics during long-time driving although it keeps exhibiting the MI characteristic.

This loses the memory property of storing the voltage-device current or voltage-emission current characteristic characterized by the maximum voltage value (Vmax) applied to the device. Further, the device current If and emission current Ie with respect to a predetermined device voltage Vf become unstable.

In a device having undergone the activation step, we can consider that the maximum voltage value (Vmax) is a maximum voltage value applied to the device in the activation step.

"The memory property is lost" results in the following variations. For example, if the device is driven by a voltage Vf lower than the maximum voltage value (Vmax) after the stabilization step, the voltage-device current (or voltage-emission current) characteristic shifts to one characterized by the voltage Vf, thereby increasing the device current If and emission current Ie.

Even under these circumstances, the driving method of the present invention can effectively suppress time variations in characteristic arising from the increases in device current If and emission current Ie.

"Driving" and "driving method" in the present invention mean the step of applying the voltage to the device after the electron-emitting device is manufactured. In a device requiring the activation step, the manufacture of the electron-emitting device is completed by performing the forming step, activation step, and stabilization step.

An example of the driving method of the present invention will be described.

For example, several measurement voltages V1 having different voltage values are applied to the device after the stabilization step. The initial device current If1 is measured for each measurement voltage V1, and stored in a memory or the like (first measurement step). The measurement voltage V1 is equal to or lower than Vmax, and is preferably a driving voltage Vf.

In a driving method of controlling the emission electron amount Ie from the electron-emitting device by the pulse width of a pulse-like voltage applied to the device, the driving voltage Vf is kept constant. It is therefore preferable that the measurement voltage V1 be set equal to the driving voltage value Vf, and the initial device current If1 be measured and stored.

In a driving method of controlling the emission electron amount Ie from the electron-emitting device by the pulse peak value of a pulse-like voltage applied to the device, the driving voltage Vf changes. It is therefore preferable that several measurement voltages V1 having different voltage values be set, and the initial device current If1 be measured and stored.

However, even in the control using the peak value as well as the control using the pulse width, a device current If for only a given measurement voltage value V1 may be set as the initial device current If1.

Also when the device is driven by controlling the emission electron amount by the peak value (voltage value), the driving voltage Vf is set lower than the maximum voltage value (Vmax). When no voltage is applied to the device after the activation step during the manufacture of the device, the maximum voltage value applied to the device in the activation step corresponds to Vmax.

The electron-emitting device is driven after the first measurement step.

While the device is driven, the device current is measured by the ammeter 50 always or periodically at a predetermined interval (second measurement step). Whether device characteristics vary is determined by the device current If2 when a voltage equal to the measurement voltage V1 applied in the first measurement step is applied to the device.

When the device current monitoring controller 57 monitors that the device current If2 monitored in the second measurement step reaches a predetermined value (described later) from the initial device current If1, the following characteristic recovery driving (voltage application step) A and/or B is executed.

In the simplest case, when the device current If2 monitored in the second measurement step is determined to increase from the initial device current If1, the following characteristic recovery driving (voltage application step) is executed.

Characteristic Recovery Driving Method A

The power supply 51 is instructed to apply for a proper time the voltage V2 equal to or lower than the maximum voltage value Vmax applied to the device before the first measurement step (including the device manufacturing step) and higher than the device driving voltage Vf.

As described above, when the emission electron amount from the device is controlled by the pulse peak value applied to the device, the potential Vf applied to the device in driving is not constant. Hence, when the device is controlled by the pulse peak value applied thereto, V2 is preferably higher than the highest voltage among predetermined device driving voltage values Vf.

Characteristic Recovery Driving Method B

The power supply 51 is instructed to apply a power P2 equal to or smaller than a maximum power Pmax applied to the device before the first measurement step (including the device manufacturing step) and equal to or larger than a power P1 applied to the device in the first measurement step.

When the device is driven by applying a pulse-like voltage, the "power" corresponds to the area of one pulse waveform (integrated value with respect to the time of a voltage value applied by one pulse). For a constant-voltage, rectangular-wave pulse, the "power" corresponds to pulse peak value×pulse width. Note that it is more preferable to apply for a short time a voltage V2 higher than the measurement voltage V1 applied in the first measurement step rather than applying a low voltage for a long time.

For this reason, a pulse having both the factors A and B is preferably applied to the device. In other words, it is preferable to apply a pulse having a power equal to or larger than the power of a pulse applied in the first measurement step and having the peak value of the voltage V2 higher than the voltage V1 applied in the first measurement step.

Also in this case, when the emission electron amount from the device is controlled by the pulse peak value applied to the device, the potential Vf applied to the device in driving is not constant. Thus, in the control using the pulse peak value applied to the device, V2 is preferably set higher than the highest voltage among predetermined device driving voltage values Vf.

By applying the voltage V2 or power P2 to the device, variations in device characteristics can be suppressed.

As a result, the device characteristic can be refreshed (changed) to one characterized by the voltage V2. The refreshing mechanism is presumed to be realized because carbon or a carbon compound newly deposited near the electron-emitting portion 5 is completely or partially removed.

After characteristic recovery driving, the device driving voltage returns to a normal one (Vf).

This characteristic recovery driving provides a device current corresponding to the voltage Vf in the voltage-device current characteristic characterized by the voltage V2. Consequently, an increase in device current monitored before characteristic recovery driving can be suppressed.

After that, the first measurement step, second measurement step, and voltage application step (characteristic recovery driving) are performed again.

Every time an increase in device current If is monitored, the series of processes can be repeated to effectively suppress time variations in device current If.

The first measurement step suffices to be performed once and need not be performed after the voltage application step (characteristic recovery driving). That is, once the voltage application step (characteristic recovery driving) is performed, only the second measurement step and voltage application step (characteristic recovery driving) can be repeated like the first measurement step → the second measurement step → the voltage application step → the second measurement step → the voltage application step → the second measurement step → the voltage application step . . . . Whether to perform the characteristic recovery can be determined by comparing the device current If2 and/or emission current Ie2 measured in the second and subsequent measurement steps with the device current If1 and/or emission current Ie1 measured in the first measurement step.

When the first measurement step is done every voltage application step (characteristic recovery driving), the values (If1 and Ie1) obtained in the first measurement step may vary. To prevent this, it is preferable that the first measurement step be performed only once, and these values be compared with the values (If2 and Ie2) obtained every second measurement step.

When the device is driven by the pulse voltage in characteristic recovery driving, the application timing and pulse width of the voltage V2 are preferably changed not to vary over time the emission electron amount captured by, e.g., the anode electrode 54.

According to the above-described driving method of the present invention, characteristic recovery driving (voltage application step) is done by monitoring the device current (first and second measurement steps). Alternatively, when the emission current monitoring controller 58 detects an increase in emission current, the power supply 51 can be instructed to perform characteristic recovery driving (voltage application step). In this case, the initial emission current Ie1 is used in the first measurement step, similar to measurement of the initial device current If1.

The same control can also be realized using both the device current monitoring controller 57 and emission current monitoring controller 58.

The control is done when either one or both of the device current and emission current increase to be equal to or higher than a predetermined threshold.

In any case, according to the driving method of the present invention, the voltage V2 and/or power P2 is applied as needed. Compared to a method of applying a voltage higher than the driving voltage Vf at a predetermined interval, deterioration in device characteristics can be minimized to stably drive the device for a long time.

Figure 7:
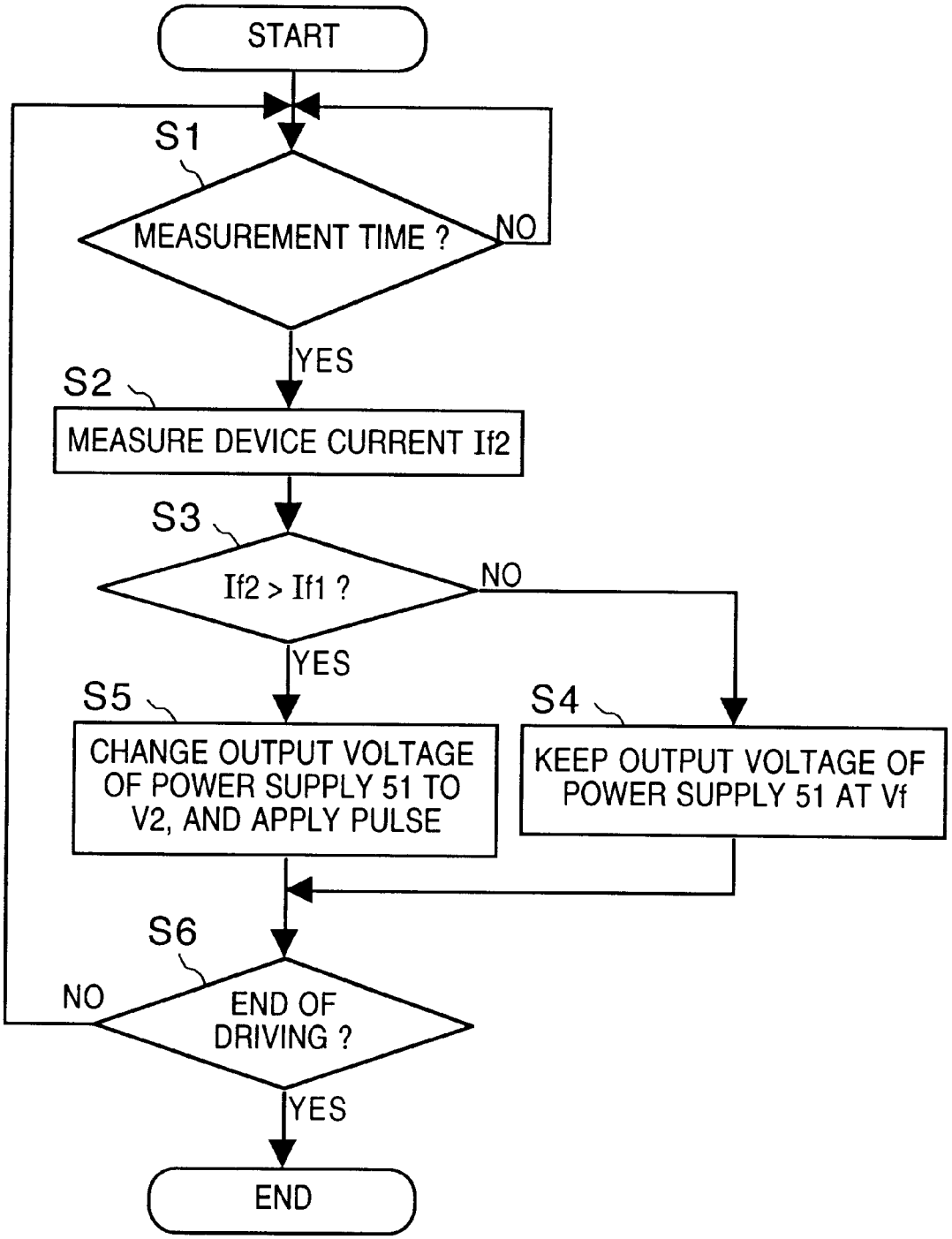
FIG. 7 is a flow chart showing an example of processing in a device current controller.

FIG. 7 is a flow chart showing processing by the device current monitoring controller 57 according to one embodiment of this invention. In this case, the emission current Ie from the electron-emitting device is controlled (driven) by the pulse width (at a constant driving voltage Vf).

In step S1, whether the current time is the measurement timing is checked. If YES in step S1, the flow shifts to step S2 to measure the device current If2 by the ammeter 50 (second measurement step). The measured device current If2 is input.

In step S3, it is checked whether the input device current If2 is larger than a predetermined current value If1 ("initial device current" measured in advance). If YES in step S3, and preferably in this invention, the device current If2 measured in the second measurement step is larger by 5% or more than the "initial device current If1" measured in advance, the flow preferably shifts to step S5 (characteristic recovery driving). If the device current If2 measured in the second measurement step is larger by 3% or more than the "initial device current If1" measured in advance, the flow more preferably shifts to step S5 (characteristic recovery driving) in this invention.

If YES in step S3, the flow advances to step S5 to change the output voltage value or output power of the power supply 51 to the voltage V2 or power P2, generate the pulse voltage signal from the power supply 51, and apply the signal to the device (perform characteristic recovery driving). If NO in step S3, the flow advances to step S4 without changing the output voltage value of the power supply 51 (without performing characteristic recovery driving).

Also in the emission current monitoring controller 58, whether the emission current Ie2 is larger than a predetermined emission current Ie1 is similarly checked in step S3. If YES in step S3, the flow advances to step S5; if NO, to step S4. Even when characteristic recovery driving is done based on an increase in emission current Ie, in this invention, the flow preferably shifts to step S5 (characteristic recovery driving) if the device current Ie2 measured in the second measurement step is determined to be larger by 5% or more than the "initial emission current Ie1". If the device current Ie2 is determined to be larger by 3% or more than the "initial emission current", in this invention, the flow more preferably shifts to step S5 (characteristic recovery driving).

This characteristic recovery driving performed during driving yields an electron-emitting device which hardly varies in electron-emitting characteristics and is stable for a long time. Note that the second measurement step is done every predetermined period, but may be done every time the driving voltage Vf is applied to the device.

An application of the electron-emitting device to which the driving method of the present invention can be applied will be described. A plurality of electron-emitting devices according to this embodiment can be laid out on a substrate to form, e.g., an electron source or image forming apparatus.

These electron-emitting devices can take various layouts. An example of the layout is a ladder-like layout in which each of electron-emitting devices laid out parallel is connected at the two terminals, a plurality of electron-emitting device rows (to be referred to as a row direction) are arranged, and electrons from the electron-emitting devices are controlled by a control electrode (to be also referred to as a grid) arranged above the electron-emitting devices in a direction (to be referred to as a column direction) perpendicular to the row wiring. Another example is a layout in which a plurality of electron-emitting devices are arranged in a matrix in the x and y directions, one electrode of each of a plurality of electron-emitting devices arranged on the same row is commonly connected to an x-direction wiring, and the other electrode of each of a plurality of electron-emitting devices arranged on the same column is commonly connected to a y-direction wiring. This layout is called a simple matrix layout. The simple matrix layout will be described in detail below.

The electron-emitting device to which the present invention can be applied has the above-mentioned features (i) to (iii). That is, when the voltage is equal to or higher than the threshold voltage, electrons emitted by the electron-emitting device can be controlled by the peak value and width of a pulse-like voltage applied between facing device electrodes. When the voltage is lower than the threshold voltage, almost no electrons are emitted. According to this feature, even if many electron-emitting devices are arranged, a pulse-like voltage can be appropriately applied to each element to select a given surface-conduction type electron-emitting device and control the electron emission amount in accordance with an input signal.

Figure 8:
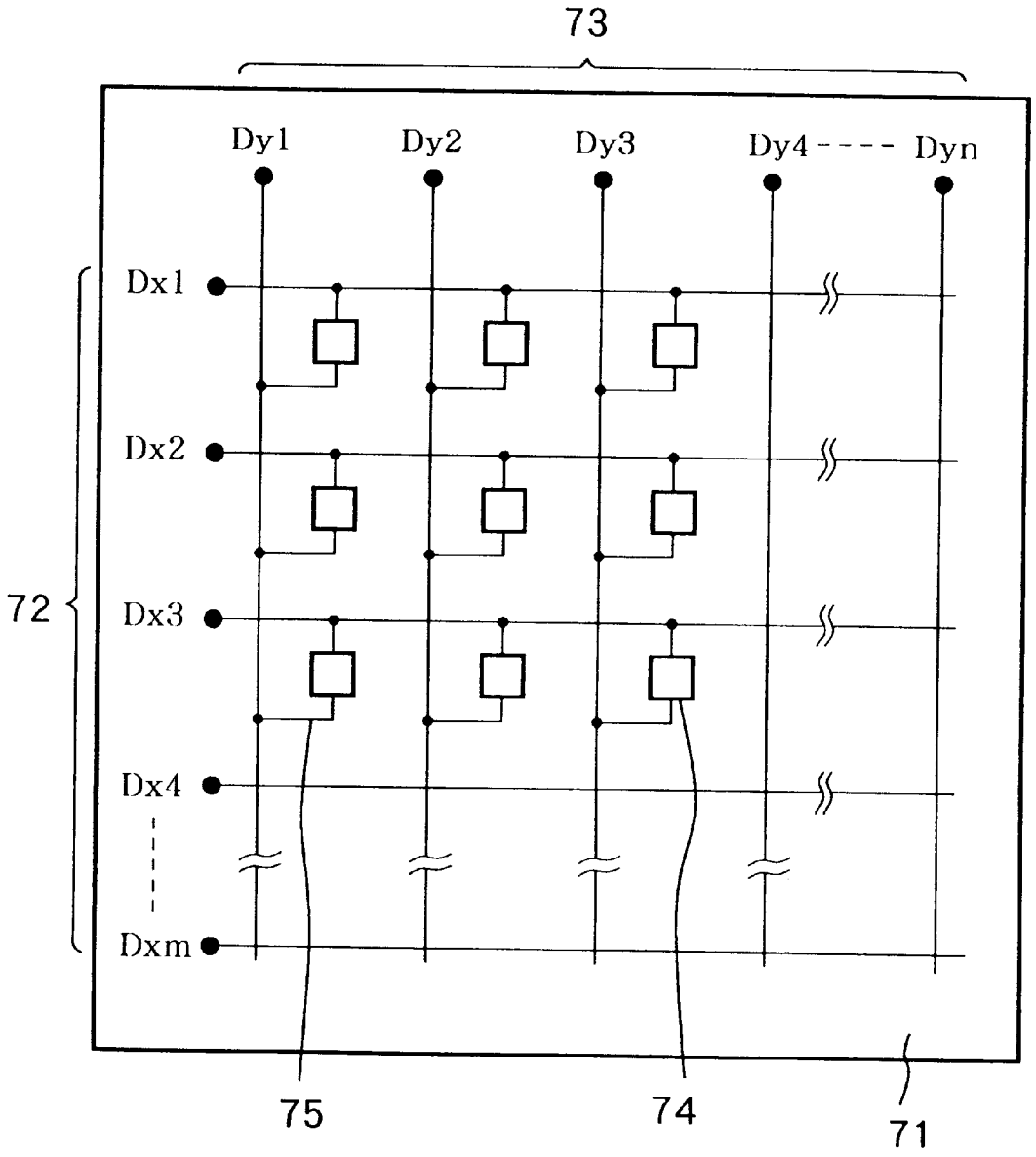
FIG. 8 is a plan view showing an example of an electron source having a matrix layout.

On the basis of this principle, an electron source substrate obtained by arranging a plurality of electron-emitting devices of this embodiment will be explained with reference to FIG. 8. FIG. 8 is a plan view showing an electron source obtained by laying out these electron-emitting devices in a matrix.

In FIG. 8, reference numeral 71 denotes an electron source substrate; 72, x-direction wirings; 73, y-direction wirings; 74, electron-emitting devices; and 75, connections. Note that the electron-emitting device 74 may be of a flat or step type.

M x-direction wirings 72 (Dx1, Dx2, . . . , Dxm) can be made of, e.g., a conductive metal formed by vacuum evaporation, printing, sputtering, or the like. The material, thickness, and width of the wiring are properly designed. N y-direction wirings 73 (Dy1, Dy2, . . . , Dyn) are formed similarly to the x-direction wirings 72. An interlevel insulating layer (not shown) is formed between the m x-direction wirings 72 and n y-direction wirings 73 to electrically isolate them (m, n are positive integers).

The interlevel insulating layer (not shown) is made of, e.g., $SiO_2$ formed by vacuum evaporation, printing, sputtering, or the like. For example, the interlevel insulating layer is formed into a desired shape on the entire surface or part of the substrate 71 having the x-direction wirings 72. The thickness, material, and fabrication method of the interlevel insulating layer are appropriately set to stand particularly the potential difference at the intersection of the x- and y-direction wirings 72 and 73. The x- and y-direction wirings 72 and 73 are extracted as external terminals. A pair of electrodes (2 and 3 in FIGS. 1A and 1B) constituting the electron-emitting device 74 are electrically connected to one of the m x-direction wirings 72 and one of the n y-direction wirings 73 by the connection 75 made of, e.g., a conductive metal.

The material for the x- and y-direction wirings 72 and 73, the material for the connection 75, and the material for the pair of device electrodes 2 and 3 may contain some or all of the constituents which are the same, or may contain different constituents. These materials are appropriately selected from the above-described materials for the electrodes 2 and 3. When the material for the electrodes 2 and 3 is the same as the material for the wirings 72, 73, and 75, wirings connected to the electrodes 2 and 3 may also be called electrodes.

The x-direction wirings 72 are connected to a scan signal application means (e.g., a scan circuit 102 in FIG. 13) for applying a scan signal for selecting a row of electron-emitting devices 74 arranged in the x direction. The y-direction wirings 73 are connected to a modulation signal generation means (e.g., a modulation circuit 107 in FIG. 13) for modulating each column of electron-emitting devices 74 arranged in the y direction in accordance with an input signal. The driving voltage applied to each electron-emitting device serves as a difference voltage between a scan signal and modulation signal applied to this device.

In this arrangement, individual devices can be selected and independently driven using simple matrix wiring.

An image forming apparatus using this electron source with a simple matrix layout will be explained with reference to FIGS. 9 to 13.

Figure 9:
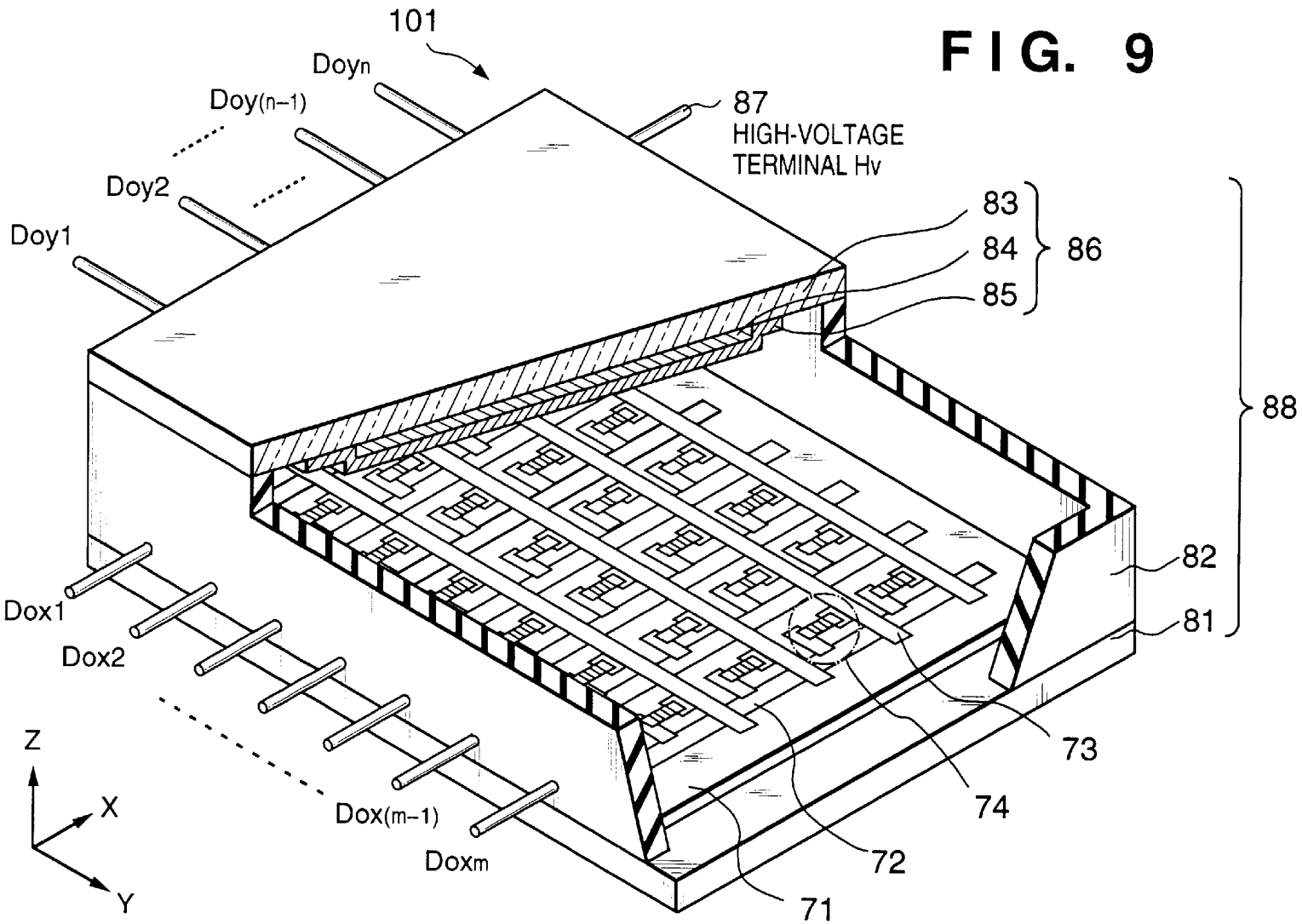
FIG. 9 is a partially cutaway perspective view showing the outer appearance of a display panel.
Figure 10A:
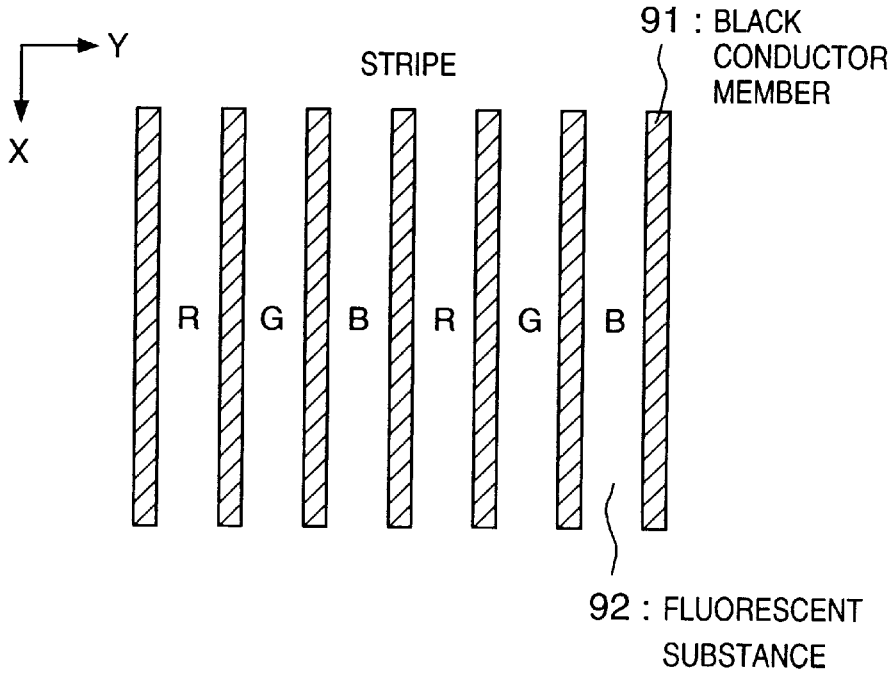
FIGS. 10A and 10B are plan views each showing an example of the layout of the fluorescent substances of a fluorescent film.
Figure 10B:
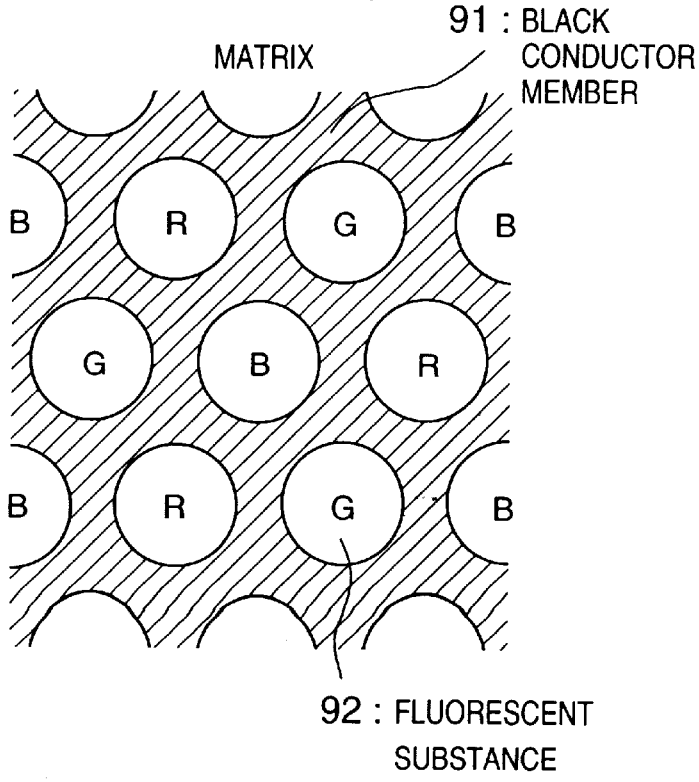
Figure 11:
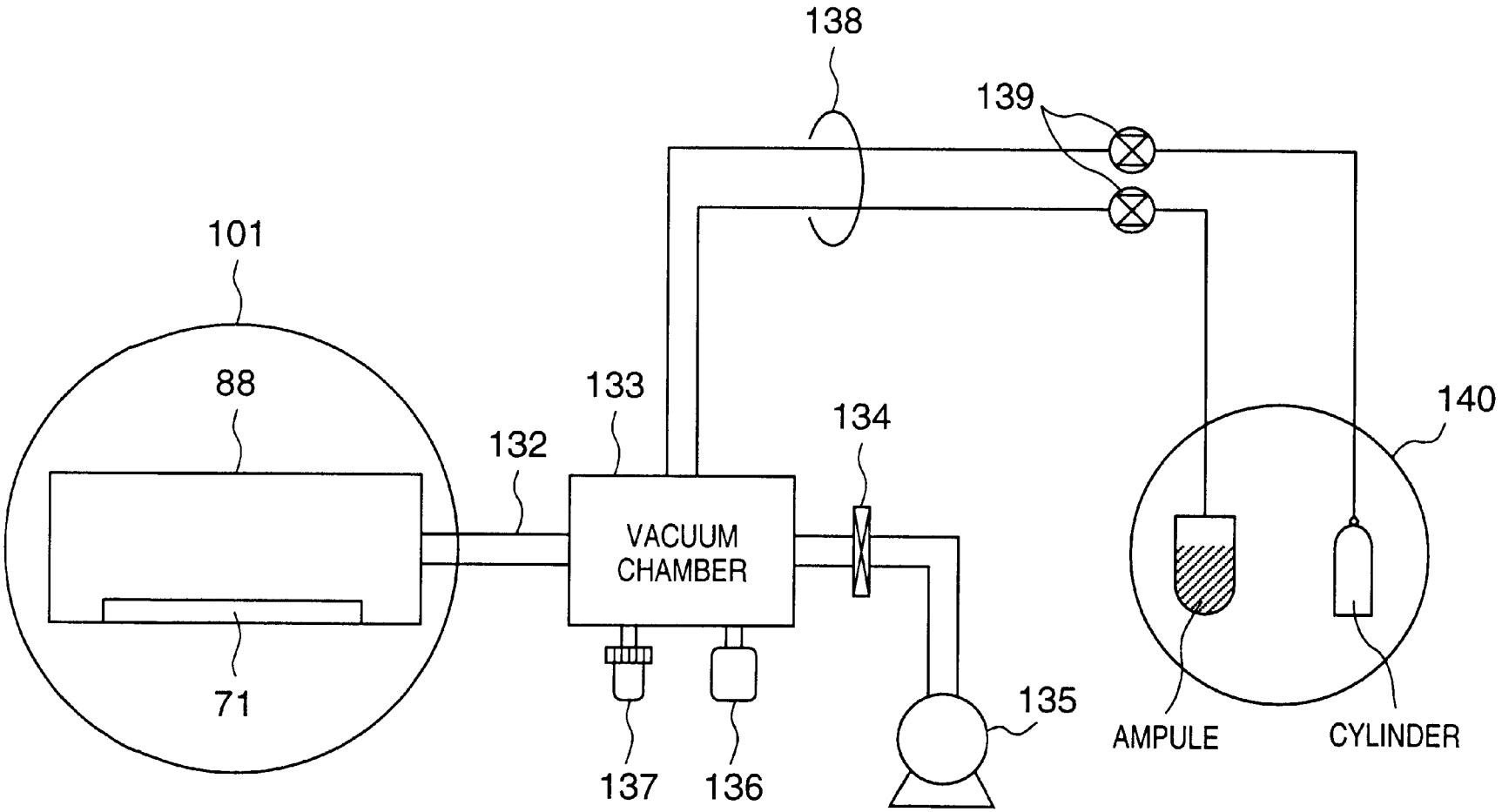
FIG. 11 is a block diagram showing the arrangement of an evacuation device for performing the forming and activation steps in the display panel according to the embodiment.
Figure 13:
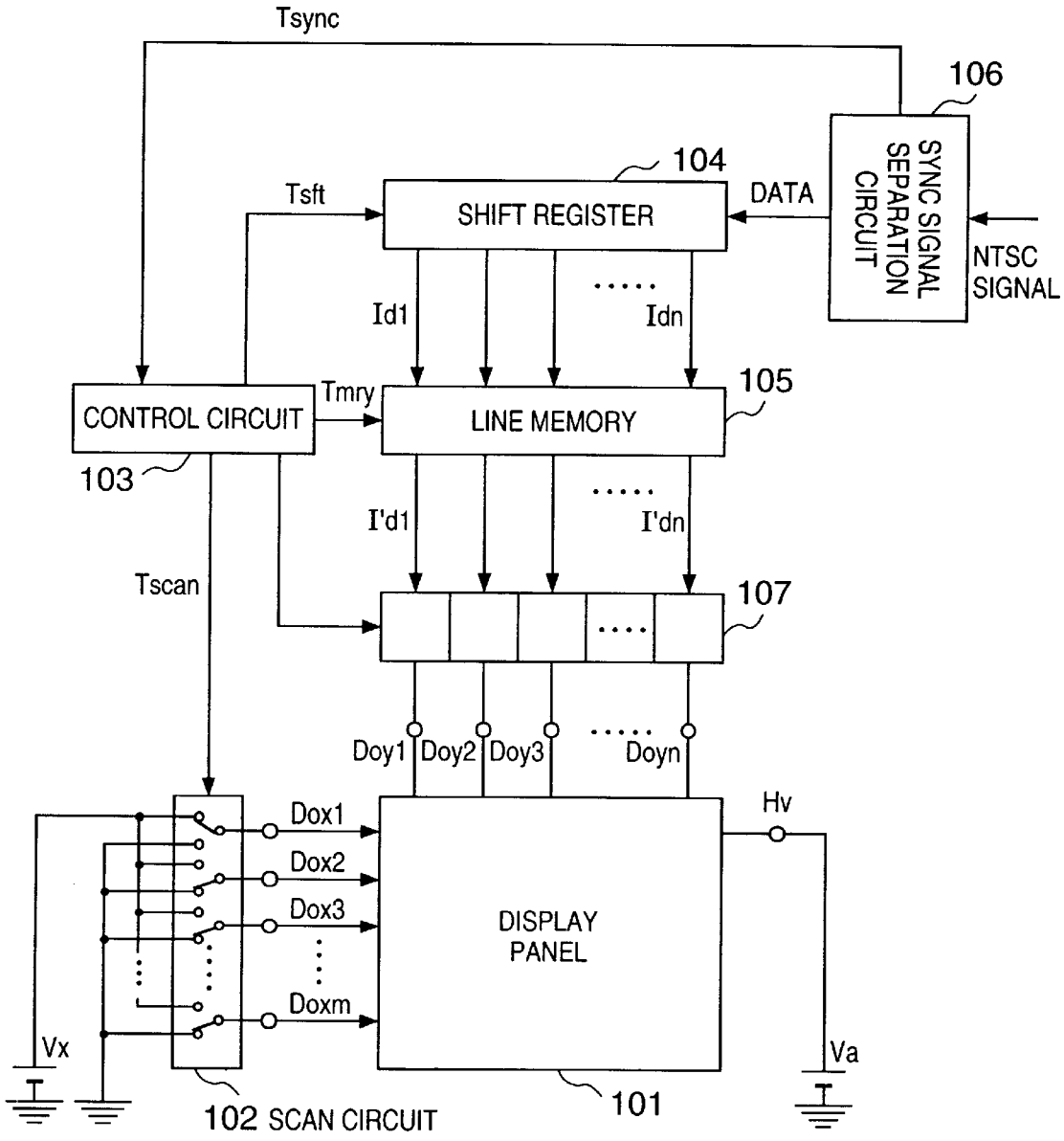
FIG. 13 is a block diagram showing an example of the driving circuit of a display panel in an image display apparatus according to the embodiment.

FIG. 9 is a schematic view showing an example of a display panel 101 of the image forming apparatus. FIGS. 10A and 10B are schematic views each showing a fluorescent film used in the image forming apparatus in FIG. 9. FIG. 11 is a block diagram showing the arrangement of a manufacturing apparatus for the image forming apparatus. FIG. 13 is a block diagram showing an example of a driving circuit for performing display in accordance with a TV signal of the NTSC scheme.

In FIG. 9, reference numeral 71 denotes an electron source substrate on which a plurality of electron-emitting devices are arranged; 81, a rear plate fixing the electron source substrate 71; 86, a face plate having a fluorescent film 84, metal back 85, and the like formed on the inner surface of a glass substrate 83; 82, a support frame connected to the rear plate 81 and face plate 86 with a low-melting-point frit glass or the like; 74, electron-emitting devices corresponding to the devices shown in FIGS. 1A, 1B, 20A, and 20B; and 72 and 73, x- and y-direction wirings each connected to a pair of electrodes of a corresponding electron-emitting device.

As described above, an envelope 88 comprises the face plate 86, support frame 82, and rear plate 81. When the substrate 71 itself has a satisfactory strength, the rear plate 81 can be eliminated because the rear plate 81 is employed to reinforce mainly the strength of the substrate 71. That is, the support frame 82 maybe directly connected to the substrate 71 to constitute the envelope 88 by the face plate 86, support frame 82, and substrate 71.

Alternatively, a support (not shown) called a spacer may be disposed between the face plate 86 and rear plate 81 to constitute the envelope 88 having a strength enough to stand the atmospheric pressure.

FIGS. 10A and 10B are schematic views each showing the fluorescent film.

For monochrome display, the fluorescent film 84 can be formed from only a fluorescent substance. A color fluorescent film can be formed from a black conductive member 91 called a black stripe or matrix, and a fluorescent substance 92 in accordance with the layout of the fluorescent substance. The black stripe or black matrix is provided to suppress color mixing or the like by coloring in black the boundaries between respective fluorescent substances 92 of three primary colors necessary for color display, and to suppress a decrease in contrast by shutting off reflection of external light by the fluorescent film 84. Examples of the material for the black stripe are a material containing normally used graphite as a main component, and a conductive material which hardly transmits and reflects light.

As a method of coating the glass substrate 83 with the fluorescent substance, precipitation, printing, or the like can be adopted regardless of the monochrome or color display. The metal back 85 is generally formed on the inner surface of the fluorescent film 84. The metal back is provided to increase the luminance by mirror-reflecting to the face plate 86 part of light emitted from the fluorescent substance toward the inner surface, to operate the metal back 85 as an electrode for applying an electron acceleration voltage, and to protect the fluorescent substance 92 from damage by collision of anions generated in the envelope. The metal back is formed by performing smoothing processing (generally called "filming") for the inner surface of the fluorescent film 84 after forming the fluorescent film 84, and depositing aluminum (Al) by vacuum evaporation or the like.

To improve the conductivity of the fluorescent film 84, the face plate 86 may comprise a transparent electrode (not shown) on the outer surface of the fluorescent film 84.

In sealing, fluorescent substances of respective colors and electron-emitting devices must correspond to each other and must be aligned with high precision.

An example of the method of manufacturing the display panel 101 shown in FIG. 9 will be described. FIG. 11 is a block diagram schematically showing a manufacturing apparatus for executing this manufacturing method.

The envelope 88 is coupled to a vacuum chamber 133 via an exhaust pipe 132, and connected to an exhaust device 135 via a gate valve 134. The vacuum chamber 133 is equipped with a pressure gauge 136, quadruple-pole mass spectrometer 137, and the like in order to measure the internal pressure and the partial pressure of each component in the atmosphere. Since it is difficult to directly measure the internal pressure of the envelope 88 of the display panel 101 and the like, the internal pressure of the vacuum chamber 133 and the like are measured to control processing conditions. The vacuum chamber 133 is connected to a gas supply line 138 for introducing a necessary gas into the vacuum chamber 133 to control the atmosphere. The other end of the gas supply line 138 is connected to a supply substance source 140 where a supply substance is stored in an ampule or cylinder. A gas supply control means 139 for controlling the supply rate of the supply substance is inserted in the gas supply line 138. An example of the gas supply control means is a valve such as a slow leak valve capable of controlling the flow rate, a mass-flow controller, or the like in accordance with the type of supply substance.

Figure 12:
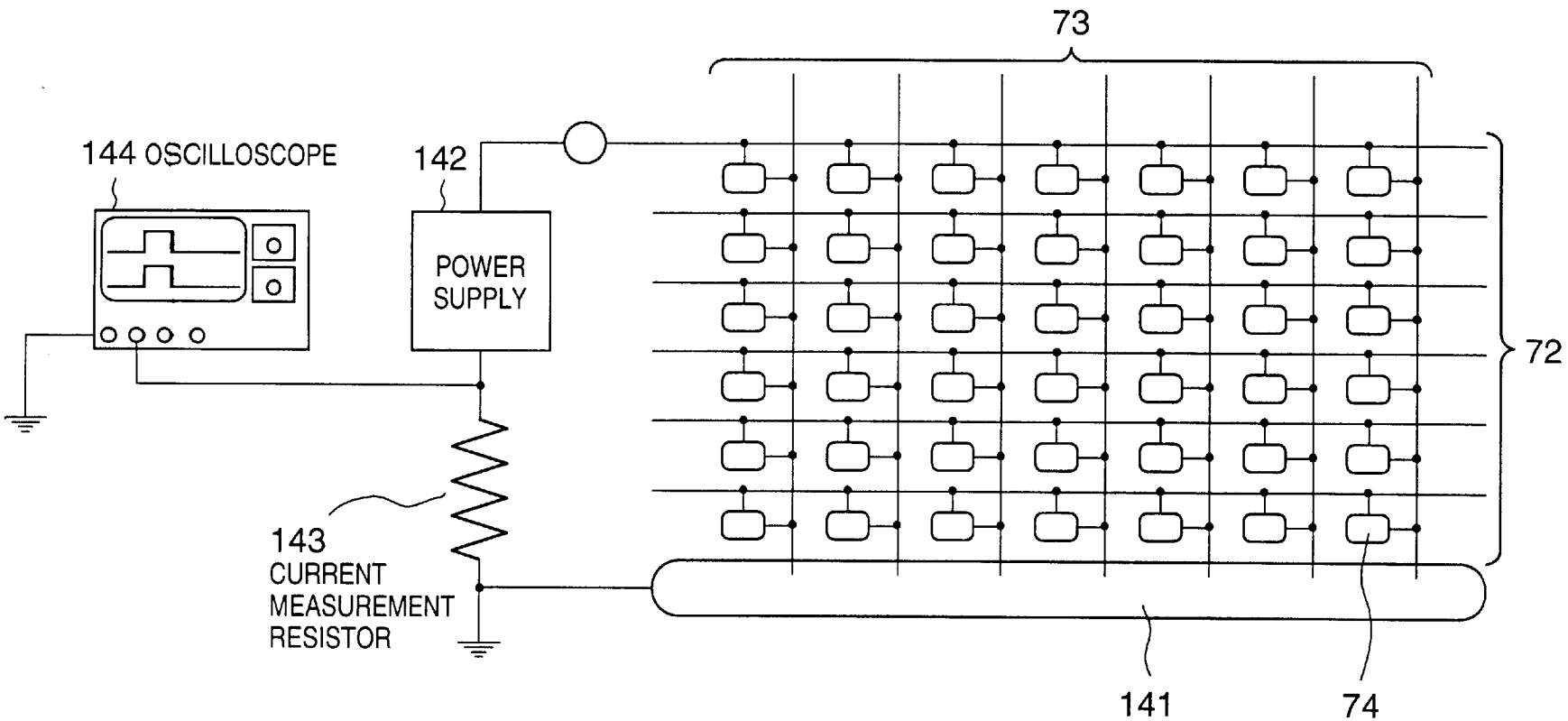
FIG. 12 is a circuit diagram showing a connection method for the forming and activation steps in the display panel according to the embodiment.

The manufacturing device in FIG. 11 evacuates the interior of the envelope 88 to perform forming processing. At this time, as shown in, e.g., FIG. 12, the y-direction wirings 73 are connected to a common electrode 141, and the voltage pulse is simultaneously applied from a power supply 142 to devices connected one of the x-direction wirings 72, thereby executing forming processing. The shape of the voltage pulse and processing end conditions are selected in accordance with the above-described individual element individual device forming method. If pulses shifted in phase are sequentially applied (scrolled) to a plurality of x-direction wirings 72, devices connected to the plurality of x-direction wirings 72 can undergo forming processing at once. In FIG. 12, reference numeral 143 denotes a current measurement resistor; and 144, a current measurement oscilloscope. After forming processing, the activation step is done for a device requiring it.

In the activation step, the interior of the envelope 88 is sufficiently evacuated, and then an organic substance is supplied via the gas supply line 138. Alternatively, as an individual device activation method, the interior of the envelope 88 may be evacuated by an oil diffusion pump or rotary pump, and an organic substance left in the vacuum atmosphere may be used. If necessary, a substance other than the organic substance may be supplied. The voltage is applied to each electron-emitting device in the organic substance atmosphere formed in this manner. Then, carbon, a carbon compound, or a mixture of them is deposited in the gap 6 formed by forming processing and on the conductive film near the gap 6, and the electron emission amount for a predetermined voltage drastically increases. As the voltage application method at this time, the voltage pulse is simultaneously applied to devices connected to one x-direction wiring by the same connection as in forming processing.

After the activation step, the stabilization step is preferably done similarly to processing of an individual device. In this stabilization step, while the envelope 88 is heat and kept at 80 to 250° C., the interior of the envelope 88 is evacuated via the exhaust pipe 132 by the exhaust device 135 such as an ion pump or sorption pump using no oil. After the organic substance is satisfactorily reduced from the atmosphere, the exhaust pipe is heated and fused by a burner to seal the envelope 88. To maintain the pressure after sealing the envelope 88, getter processing may be done. That is, immediately before or after the envelope 88 is sealed, a getter located at a predetermined position (not shown) in the envelope 88 is heated by resistance heating, RF heating, or the like, thereby forming a deposited film. The getter normally contains Ba or the like as a main component, and maintains the atmosphere in the envelope 88 by the absorption function of the deposited film.

An example of the arrangement of a driving circuit for performing television display based on a television signal of the NTSC scheme on a display panel (flat panel display) constituted using an electron source with a simple matrix layout will be explained with reference to FIG. 13.

In FIG. 13, the above-described display panel 101 corresponds to the envelope 88. Reference numeral 102 denotes a scan circuit; 103, a control circuit; 104, a shift register; 105, a line memory; 106, a sync signal separation circuit; and 107, a modulation signal generator. Reference symbols Vx and Va denote DC voltage sources. The display panel 101 is connected to an external electric circuit via row (x-direction) terminals Dox1 to Doxm, column (y-direction) terminals Doy1 to Doyn, and a high-voltage terminal Hv, as described above. The row terminals Dox1 to Doxm receive scan signals for sequentially driving the electron source on the display panel 101, i.e., a group of electron-emitting devices arranged in an m×n matrix in units of lines (in units of n devices).

The column terminals Dy1 to Dyn receive modulation signals for controlling electrons output from the electron-emitting devices on one line selected by the scan signals. The high-voltage terminal Hv applies a DC voltage of, e.g., 10 kV from the DC voltage source Va to the face plate 86 (corresponding to the anode electrode 54 in FIG. 5). This voltage is an acceleration voltage for giving energy enough to excite the fluorescent substance to electrons emitted from the electron-emitting device.

The scan circuit 102 will be described next. The scan circuit 102 incorporates m switching devices (denoted by reference symbols S1 to Sm in FIG. 13). Each switching device selects either an output voltage from a DC voltage source Vx or 0 V (ground level) and is electrically connected to a corresponding one of the row terminals Dx1 to Dxm of the display panel 101. The switching devices S1 to Sm operate based on a control signal Tscan (horizontal sync signal) output from the control circuit 103. The scan circuit 102 can be easily constituted by a combination of switching devices such as FETs.

In this embodiment, the DC voltage source Vx generates a voltage to be applied to an unselected row wiring on the basis of the characteristics (electron-emitting threshold voltage) of the surface-conduction type electron-emitting device, and outputs a constant voltage such that the driving voltage (difference voltage of the modulation signal) to be applied to a device not scanned is set equal to or lower than the emission threshold voltage of the electron-emitting device.

The control circuit 103 functions to match the operations of respective components with each other so as to perform proper display based on an externally input image signal. The control circuit 103 generates control signals such as a horizontal sync signal Tscan, shift clock Tsft, and memory latch signal Tmry for respective components on the basis of a sync signal Tsync sent from the sync signal separation circuit 106.

The sync signal separation circuit 106 separates sync signal and luminance signal components from an externally input NTSC television signal. This circuit can be easily formed by using a general frequency separation (filter) circuit or the like. The sync signal Tsync separated by the sync signal separation circuit 106 contains vertical and horizontal sync signals. For descriptive convenience, the sync signal is shown as the signal Tsync. The luminance signal component of an image, which is separated from the NTSC television signal, is expressed as a signal DATA for convenience. The signal DATA is input to the shift register 104.

The shift register 104 serial/parallel-converts in units of lines of an image the signals DATA serially input in a time-series manner. The shift register 104 operates based on the control signal Tsft sent from the control circuit 103 (i.e., the control signal Tsft is a shift clock for the shift register 104.) Serial/parallel-converted 1-line image data (corresponding to driving data for n electron-emitting devices) is output as n signals Id1 to Idn from the shift register 104 to the line memory 105. The line memory 105 is a memory circuit for storing 1-line image data for a necessary period of time. The line memory 105 properly stores the 1-line image data Id1 to Idn in accordance with the control signal Tmry sent from the control circuit 103. The contents stored in the line memory 105 are output as image data I'd1 to I'dn to the modulation signal generator 107.

The modulation signal generator 107 is a signal source for properly driving and modulating each electron-emitting device in accordance with each of the image data I'd1 to I'dn. Output signals from the modulation signal generator 107 are applied to the electron-emitting devices of the display panel 101 via the terminals Doy1 to Doyn.

Note that the modulation signal generator 107 may perform switching (above-described characteristic recovery driving) of the driving voltage waveform in this embodiment. When the modulation signal generator 107 performs modulation by pulse width modulation, the waveform value of an output pulse voltage is set to the voltage Vf in normal driving. When the device current monitoring controller 57 or emission current monitoring controller 58 detects that the device current If or emission current Ie increases to a predetermined value or more, the output voltage of the modulation signal generator 107 is controlled to the voltage V2 or power P2 via the control circuit 103. Then, the modulation signal pulse is changed to or superposed on the target voltage value.

This modulation method will be explained in more detail. As described above, the electron-emitting device applicable to this embodiment has the following basic characteristics with respect to the emission current Ie. A clear threshold voltage Vth exists for electron emission, and each device emits electrons only when a voltage equal to or higher than Vth is applied. For a voltage equal to or higher than the electron-emitting threshold, the emission current changes with a change in voltage applied to the device. When a pulse-like voltage is applied to the device, the device does not emit any electrons if the voltage is lower than the electron-emitting threshold. If, however, the voltage is equal to or higher than the electron-emitting threshold, the device emits electrons. In this case, the output electron amount can be controlled by changing a pulse peak value Vm. In addition, the total output electron amount can be controlled by changing a pulse width Pw. Hence, as a method of modulating an output from the electron-emitting device in accordance with an input signal, a voltage modulation method, pulse width modulation method, or the like can be used.

In executing the voltage modulation method, the modulation signal generator 107 may employ a voltage modulation circuit for generating a voltage pulse having a predetermined width, and a pulse obtained by changing or superposing this voltage pulse to or on the second driving voltage V2 or power P2, and modulating the pulse peak value in accordance with input data.

When this pulse width modulation method is adopted, the modulation signal generator 107 may employ a pulse width modulation circuit for generating a voltage pulse having a predetermined peak value, and a pulse obtained by changing or superposing this voltage pulse to or on the second driving voltage V2 or power P2, and modulating the voltage pulse width in accordance with input data.

The shift register 104 and line memory 105 may be of a digital or analog signal type because they can only serial/parallel-convert and store an image signal at predetermined speeds. When the shift register 104 and line memory 105 are of the digital signal type, the output signal DATA from the sync signal separation circuit 106 must be converted into a digital signal. For this purpose, an A/D converter may be connected to the output terminal of the sync signal separation circuit 106.

The circuit used for the modulation signal generator 107 changes depending on whether the line memory 105 outputs a digital or analog signal. In the voltage modulation method using a digital signal, the modulation signal generator 107 employs, e.g., a D/A conversion circuit, and can be equipped with an amplification circuit or the like, as needed. In the pulse width modulation method, the modulation signal generator 107 employs, e.g., a circuit as a combination of a high-speed oscillator, a counter for counting the number of waves output from the oscillator, and a comparator for comparing the output values from the counter and memory with each other. If necessary, this circuit can be equipped with an amplifier for amplifying the voltage of a pulse-width-modulated signal output from the comparator to the driving voltage of the surface-conduction type electron-emitting device.

In the voltage modulation method using an analog signal, the modulation signal generator 107 can adopt, e.g., an amplification circuit using an operational amplifier and the like, and can be equipped with a shift level circuit or the like, as needed. In the pulse width modulation method, the modulation signal generator 107 can adopt, e.g., a voltage-controlled oscillator (VCO), and can be equipped with an amplifier for amplifying an output from the oscillator to the driving voltage for the electron-emitting device, as needed.

In the image display using the display panel of this embodiment having this arrangement, the voltage is applied to electron-emitting devices via the row terminals Dox1 to Doxm and column terminals Doy1 to Doyn outside the vessel to emit electrons. A high voltage is applied to the metal back 85 or transparent electrode (not shown) via the high-voltage terminal Hv to accelerate electrons. The accelerated electrons collide against the fluorescent film 84 to cause it to emit light, thereby forming an image.

This arrangement of the image forming apparatus is merely an example of the image forming apparatus applicable to which this embodiment. Various changes and modifications of the arrangement can be made within the spirit and scope of this embodiment. Although the input signal is an NTSC signal, the input signal is not limited to this. For example, the input signal may be a PAL signal, SECAM signal, or TV signal (high-definition TV of the MUSE scheme or the like) using a larger number of scan lines.

Next, an electron source with a ladder-like layout, and an image forming apparatus using this electron source will be described with reference to FIGS. 14 and 15.

Figure 14:
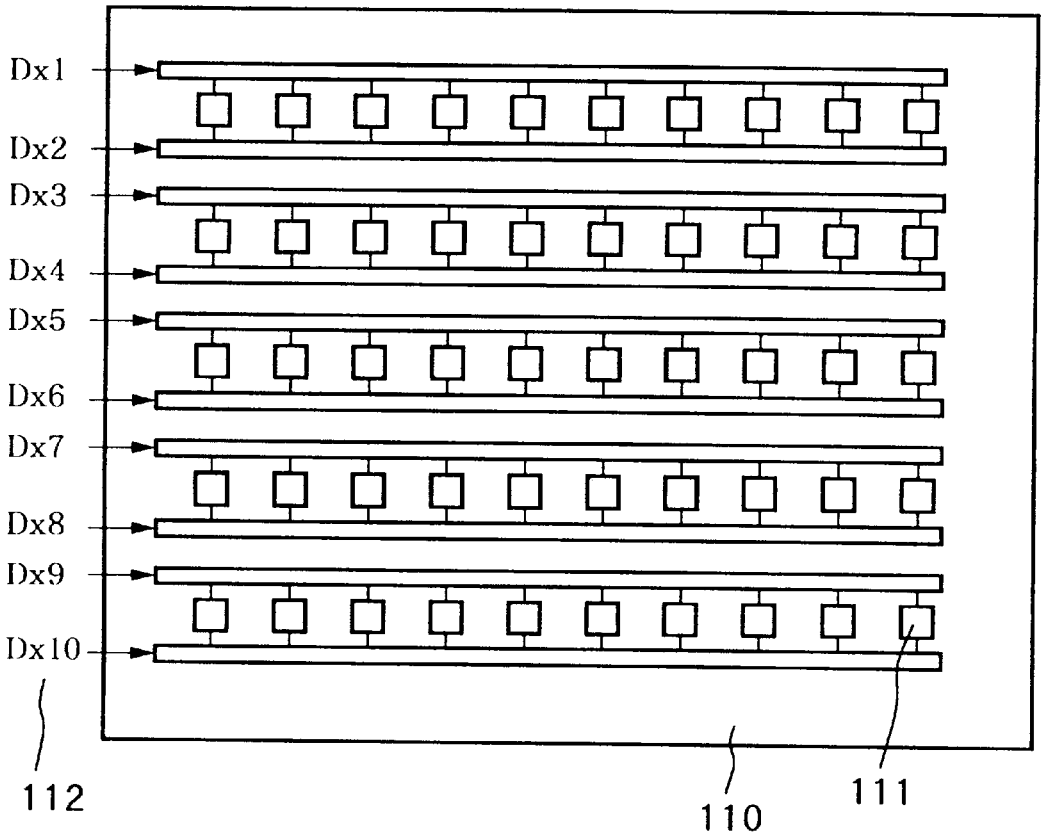
FIG. 14 is a plan view showing an example of an electron source having a ladder-like layout according to the embodiment.

FIG. 14 is a schematic view showing an example of an electron source with a ladder-like layout according to this embodiment.

In FIG. 14, reference numeral 110 denotes an electron source substrate; 111, electron-emitting devices; and Dx1 to Dx10 (112), common wirings for connecting the electron-emitting devices 111. A plurality of electron-emitting devices 111 are arranged parallel in the x direction on the substrate 110 (to be referred to as a device row). A plurality of device rows are laid out to constitute the electron source. Respective device rows can be independently driven by applying a driving voltage between the common wirings of the device rows. A voltage equal to or higher than the electron-emitting threshold (Vth) is applied to a device row required to emit electrons, whereas a voltage equal to or lower than the electron-emitting threshold is applied to a device row not to emit any electrons. The common wirings Dx2 to Dx9 between device rows can be changed such that Dx2 and Dx3 share the same wiring.

Figure 15:
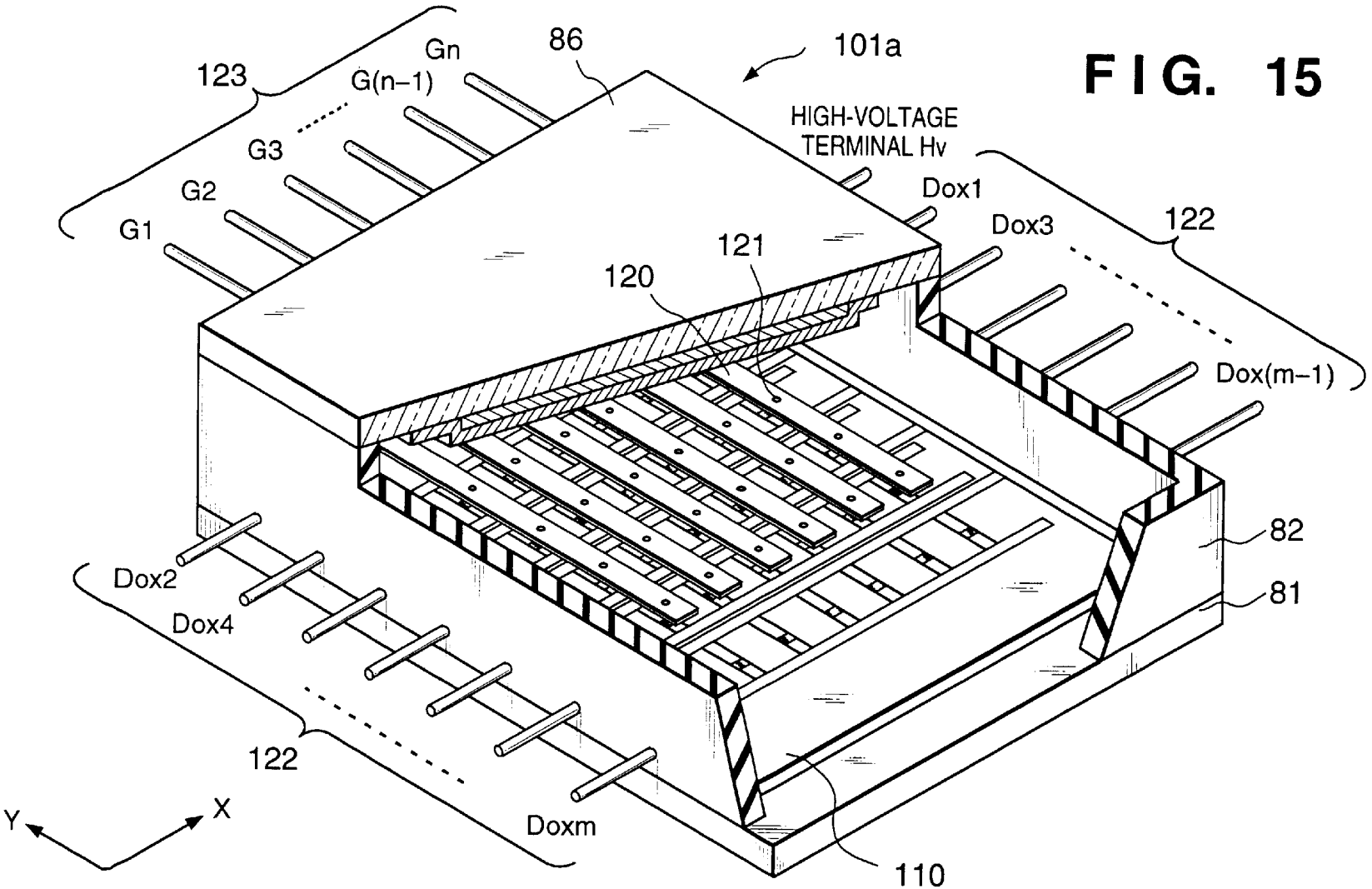
FIG. 15 is a partially cutaway perspective view showing an example of the outer appearance of a display panel using the electron source in FIG. 14.

FIG. 15 is a schematic view showing an example of the structure of a display panel 101*a* having the electron source with a ladder-like layout shown in FIG. 14.

Reference numeral 120 denotes grid electrodes; 121, openings for passing through electrons; 122, outer row terminals Dox1, Dox2, . . . , Doxm; and 123, outer column terminals G1, G2, . . . , Gn connected to the grid electrodes 120. In FIG. 15, the same reference numerals as in FIG. 9 denote the same parts. The display panel 101*a* shown in FIG. 15 is greatly different from the display panel 101 with a simple matrix layout shown in FIG. 9 in the presence of the grid electrode 120 between the electron source substrate 110 and a face plate 86.

In FIG. 15, the grid electrode 120 is interposed between the substrate 110 and face plate 86. The grid electrode 120 modulates electrons emitted by the electron-emitting device. Each grid electrode 120 has one circular opening 121 in correspondence with each device in order to pass electrons through the stripe electrode perpendicular to each device row of the ladder-like layout. The shape and position of the grid electrode 120 are not limited to those shown in FIG. 15. For example, many aperture holes can be formed in a mesh-like layout as the openings 121, and the grid electrodes 120 can be formed around or near the electron-emitting device.

The outer row terminals 122 and grid terminals 123 are electrically connected to, e.g., the above-mentioned scan circuit 102 and modulation signal generator 107.

In the display panel 101*a* of this embodiment, 1-line modulation signals are simultaneously applied to columns of the grid electrodes 120 while sequentially driving (scanning) device rows in units of lines. This allows controlling irradiation of electrons emitted from each device on the fluorescent substance to display an image in units of lines. The image forming apparatus using the display panel 101*a* of this embodiment can be used as a display apparatus for television broadcasting, a display apparatus for a video conference system, computer, and the like, and an image forming apparatus serving as an optical printer constituted by a photosensitive drum and the like.

This embodiment will be exemplified in more detail. However, the embodiment is not limited to the following examples, and respective components can be replaced and redesigned within the spirit and scope of this embodiment.

Example 1

Figure 20A:
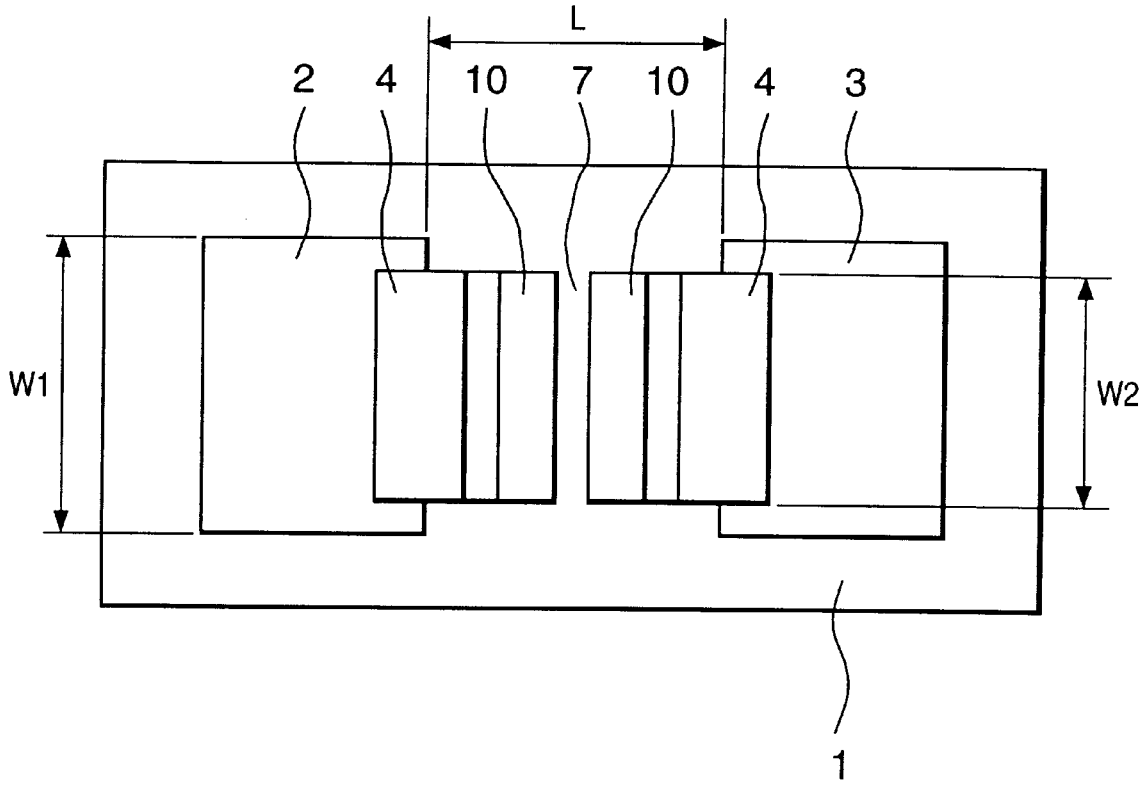
FIGS. 20A and 20B are schematic views showing an example of an electron-emitting device having a carbon film.
Figure 20B:
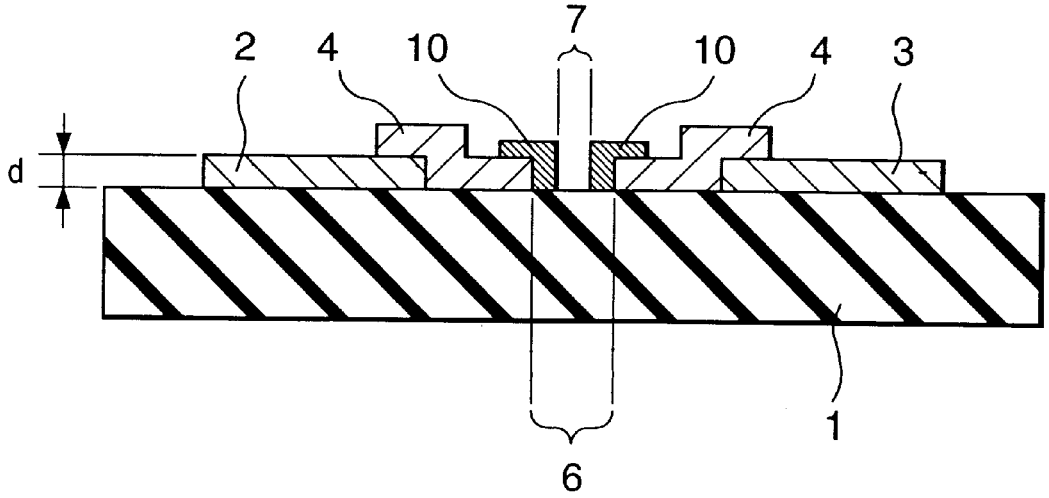

In Example 1, an electron-emitting device shown in FIGS. 20A and 20B was formed. To compare the driving method according to the present invention with another method not adopting the present invention, two devices (to be referred to as devices A and B) were formed. The experimental results of the electron-emitting characteristics of each electron-emitting device and the like will be explained.

In FIGS. 20A and 20B, reference symbol W1 denotes a width of electrodes 2 and 3; W2, a width of a conductive film 4; L, an interval between the electrodes 2 and 3; and d, a thickness of the electrode 2 or 3. Since the shapes, structures, and manufacturing processes of the devices A and B are the same up to the stabilization step (to be described later), the devices A and B will be explained without discriminating them up to the stabilization step.

The procedures of manufacturing each device used in Example 1 will be described in detail with reference to FIGS. 21A to 21D.

(1) A quartz substrate was used as a substrate 1, and satisfactorily cleaned with a detergent, pure water, and organic solvent. Then, Ti and Pt were sequentially deposited by vacuum evaporation to thicknesses of 5 nm and 50 nm, respectively. A pattern for the electrodes 2 and 3 and gap L was formed from a photoresist and dry-etched to form electrodes 2 and 3. The interval L was 3 $\mu$m (FIG. 21A).

To pattern the conductive film 4, a lift-off Cr film (not shown) having a thickness of 50 nm was formed by vacuum evaporation. At this time, the opening size of the Cr film corresponding to the width W2 of the conductive film 4 was 300 $\mu$m.

(2) The substrate 1 having the electrodes 2 and 3 was spin-coated by a spinner with an organic palladium solvent (ccp-4230 available from Okuno Seiyaku KK), thereby forming an organic Pd thin film. The organic Pd thin film was heated and sintered in the atmosphere at 300° C. for 15 min to form a conductive film 4 mainly made of PdO. The conductive film 4 was about 7 nm thick.

The Cr film was wet-etched with an acid etchant to lift off the conductive film 4 into a desired pattern (FIG. 21B).

(3) Both the devices A and B were installed in an evaluation/measurement vacuum vessel 55 in FIG. 5. The voltage was applied between the electrodes 2 and 3 by a power supply 51 for applying the device voltage to flow a current through the conductive film 4, thereby forming a first gap 6 (forming processing) (FIG. 21C). This forming processing adopted the voltage waveform shown in FIG. 4B for both the devices A and B.

In Example 1, T1 and T2 in FIG. 4B were 1 msec and 10 msec, respectively. Forming processing was done while increasing the pulse peak value by 0.1 V. During forming processing, a resistance measurement pulse of 0.1 V was applied during T2 to measure the resistance. When the value measured by the resistance measurement pulse reached about 1 MΩ or more, forming processing was stopped. At the same time, application of the voltage to the device was stopped.

(4) While both the devices A and B were kept set in the vacuum vessel 55, acetone was supplied into the device at $1.3\times10^{-3}$ [Pa]. The pulse voltage was applied between the electrodes 2 and 3 of each of the devices A and B about 30 min, thereby performing activation processing. In Example 1, a rectangular-wave positive voltage pulse, and a negative voltage pulse having an opposite polarity and the same waveform and voltage absolute value were alternately applied, as shown in FIG. 22B. T1 and T2 were 1 msec and 10 msec, respectively, and the pulse peak value (absolute value) was 15 V for both the devices A and B.

By this step, a carbon film 10 was formed in the first gap 6 and on the conductive film 4 near the first gap. At the same time, a second gap 7 narrower than the first gap 6 was formed (FIG. 21D).

(5) Acetone in the vacuum vessel was exhausted, and then the device and whole vacuum vessel were heated at 150° C.

for 2 h to set $1.3\times10^{-6}$ [Pa] in the vacuum vessel 55, thereby performing the stabilization step.

Even after the stabilization step, while the vacuum degree was maintained, the electron-emitting devices A and B were measured their device currents If and emission currents Ie. The measuring conditions were a distance H of 5 mm between an anode electrode 54 and electron-emitting device and a potential of 1 kV for the anode electrode 54.

The waveform shown in FIG. 4A was used for the device A. The pulse width T1 and pulse interval T2 were respectively set to 0.2 msec and 10 msec, and three pulses having a peak value of 15 V were applied to measure the emission current Ie. The pulse width T1 and pulse interval T2 were respectively set to 0.2 msec and 10 msec, and three pulses having a peak value of 14 V were applied to measure the emission current Ie (first measurement step). The emission current Ie was about 40% the current obtained by applying the pulse having a peak value of 15 V. Therefore, when a pulse having a peak value of 15 V was applied, the pulse width was set about 40% the pulse width T1. With this setting, charges captured by the anode electrode 54 every pulse were confirmed to be almost equal to charges captured when the peak value was 14 V.

The characteristics of the devices A and B were evaluated for 500 h.

The driving pulse waveform was basically the waveform shown in FIG. 4A for both the devices A and B, and the peak value of the driving voltage Vf was 14 V. The pulse width T1 and pulse interval T2 were 0.2 msec and 10 msec, respectively.

As for the device A, an increase in device current If was monitored by a device current monitoring controller 57. When a 3% increase in device current was detected, the power supply 51 for applying the device voltage to the electron-emitting device was instructed to apply one pulse having a voltage peak value of 15 V instead of a pulse having a driving voltage Vf peak value of 14 V (characteristic recovery driving). The pulse width for a peak value of 15 V was 0.08 msec, 40% the pulse width of 0.2 msec.

As for the device B, pulses having a constant peak value of 14 V were kept applied without performing the above characteristic recovery driving operation for the device A. The device currents If and emission currents Ie of the devices A and B were measured when the pulse having a peak value of 14 V was applied.

This experiment revealed that after the 500-h driving experiment, the device B exhibited a variation of about 50% due to an increase in device current If, but the device A exhibited only a variation of about 3% falling within the driving control range. Along with this, the emission current Ie also exhibited only a variation of about 3%, and the device A could be very stably driven.

Note that when the peak value was 14 V, both the devices A and B increased in device current If due to unsatisfactory removal of the organic substance and the like.

According to the driving method of Example 1, even when the device current If increases due to unsatisfactory removal of the organic substance and the like, the device can be very stably driven for a long time.

Example 2

A device C was formed by the same process as in Example 1 up to the stabilization step.

Even after the stabilization step, while the vacuum degree was maintained, the device C was applied a voltage to measure the device current If and emission current Ie.

The waveform shown in FIG. 4A was used for the device C. The pulse width T1 and pulse interval T2 were respectively set to 0.2 msec and 10 msec, and three pulses having a peak value of 15 V were applied to measure the emission current Ie. The pulse width T1 and pulse interval T2 were respectively set to 0.2 msec and 10 msec, and three pulses having a peak value of 14 V were applied to measure the emission current Ie (first measurement step). As a result, the emission current Ie was about 40% the emission current obtained by applying the pulse having a peak value of 15 V. Therefore, when a pulse having a peak value of 15 V was applied, the pulse width was set about 40% that for a peak value of 14 V. With this setting, charges captured by an anode electrode 54 every pulse were confirmed to be almost equal to charges captured when the peak value was 14 V.

The characteristics of the device C were evaluated for 500 h.

The driving pulse waveform was basically the waveform shown in FIG. 4A, and the peak value of the driving voltage Vf was 14 V. The pulse width T1 and pulse interval T2 were 0.2 msec and 10 msec, respectively. As for the device C, an increase in emission current Ie was monitored by an emission current monitoring controller 58. When a 3% increase in emission current was detected, a power supply 51 for applying the device voltage to the electron-emitting device was instructed to apply one pulse having a voltage peak value of 15 V instead of a pulse having a driving voltage Vf peak value of 14 V (characteristic recovery driving). The pulse width for a peak value of 15 V was 0.08 msec, 40% the pulse width of 0.2 msec.

The device current If and emission current Ie of the device C were measured when the pulse having a peak value of 14 V was applied.

The 500-h driving experiment was conducted to find that the device C exhibited only an emission current variation of about 3% falling within the driving control range, and could be very stably driven. Note that when the peak value was 14 V, the device C increased in device current If due to unsatisfactory removal of the organic substance and the like.

According to the driving method of Example 2, even when the device current If increases due to unsatisfactory removal of the organic substance and the like, and the emission current Ie also increases along with this, the device can be very stably driven for a long time.

Example 3

In Example 3, an image forming apparatus like the one shown in FIG. 9 was fabricated using an electron source (FIG. 8) obtained by arranging a plurality of electron-emitting devices shown in FIGS. 20A and 20B. An application of the driving method of Example 3 will be described.

Figure 16:
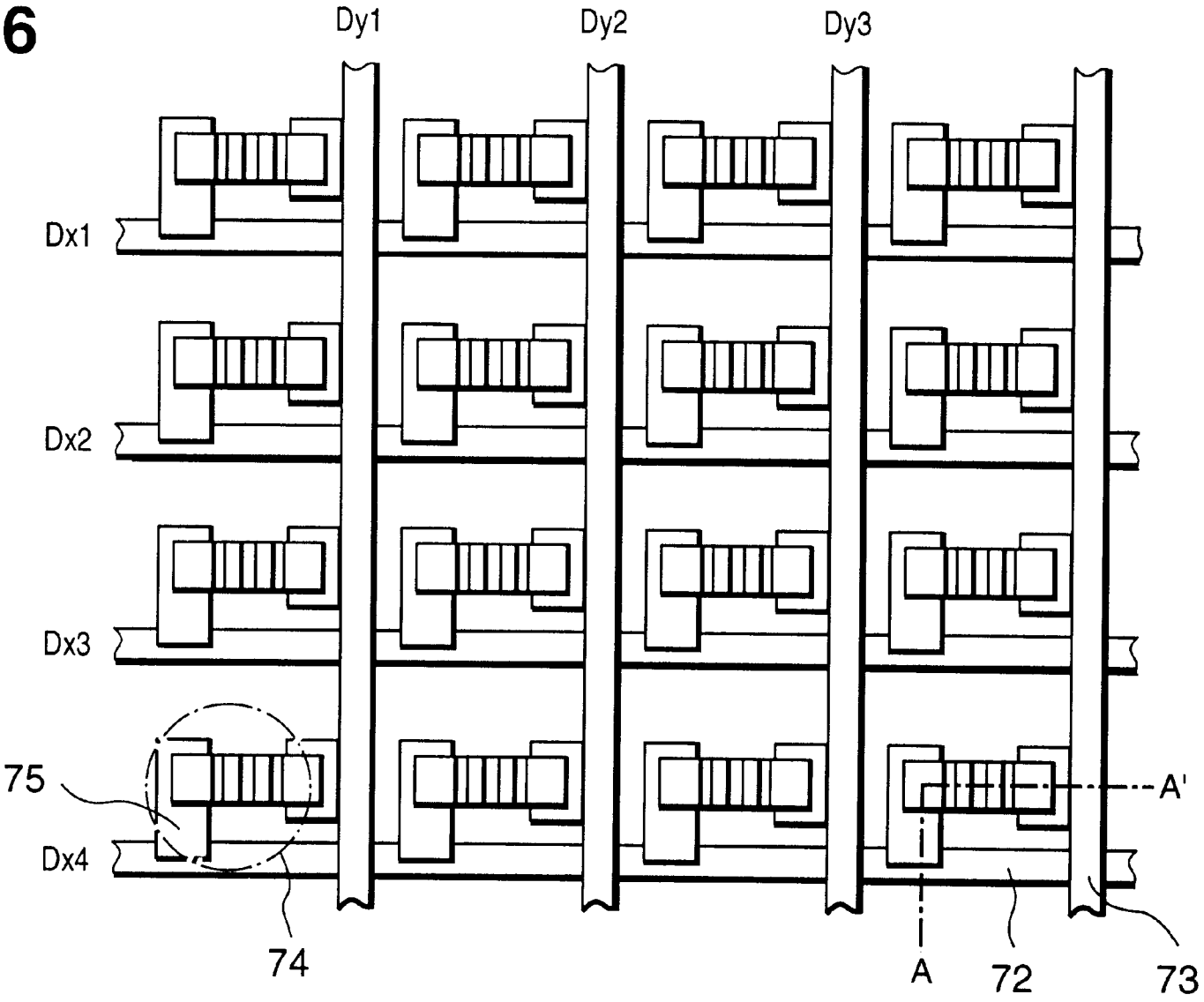
FIG. 16 is a partial plan view showing an electron source having a simple matrix layout according to the embodiment.

FIG. 16 is a plan view showing part of a substrate 71 on which a plurality of electron-emitting devices 74 are laid out in a matrix. Th electron source of the image forming apparatus in Example 3 is constituted by laying out a plurality of electron-emitting devices shown in FIGS. 20A and 20B in a matrix.

Figure 17:
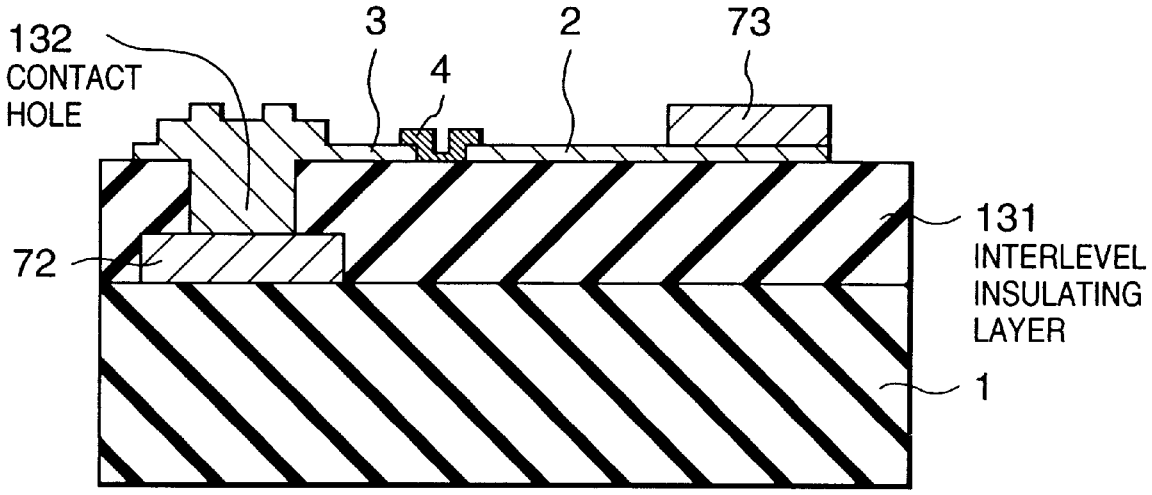
FIG. 17 is a partial sectional view showing the electron source in FIG. 16.

FIG. 17 is a sectional view taken along the line A–A' in FIG. 16. In FIGS. 16 and 17, the same reference numerals denote the same parts. In FIGS. 16 and 17, reference numeral 1 denotes a substrate; 72, x-direction wirings (lower wirings) corresponding to Doxm in FIG. 9; 73, y-direction wirings (upper wirings) corresponding to Doyn in FIG. 9; 4, a conductive film; 2 and 3, electrodes; 131, an interlevel insulating layer; and 132, a contact hole.

The manufacturing method will be explained in the processing order with reference to FIGS. 18A to 18D and 19E to 19H.

Step-a

Figure 18A:
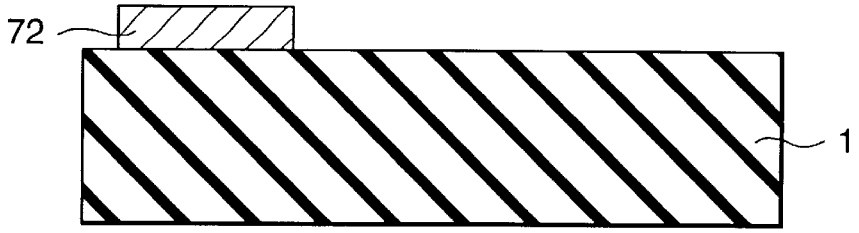
FIGS. 18A to 18D are sectional views for explaining the steps in manufacturing the electron source in FIG. 16.

A substrate 1 prepared by sputtering a silicon oxide film 0.5 μm thick on a cleaned soda-lime glass was spin-coated by a spinner with a photoresist (RD-2000N available from Hitachi Chemical Co., Ltd.). After the obtained structure was baked, a photomask image was exposed and developed to form a resist pattern for the lower wiring 72. Cr, Cu, and Cr were sequentially deposited by vacuum evaporation to thicknesses of 20 nm, 600 nm, and 50 nm, respectively, and lifted off to form a Cr/Cu/Cr lower wiring 72 (FIG. 18A).

Step-b

Figure 18B:
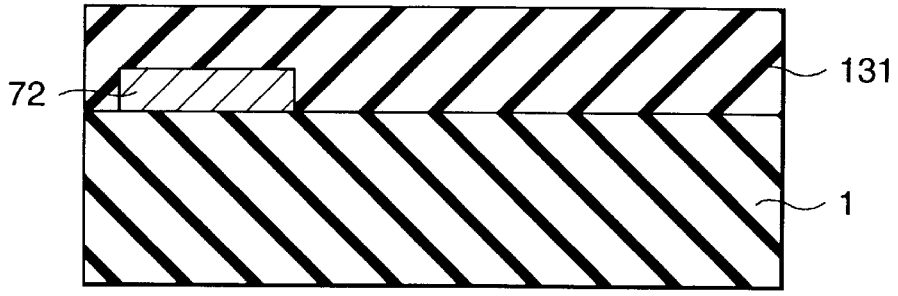

An interlevel insulating film 131 made of a 1.0-μm thick silicon oxide film was RF-sputtered (FIG. 18B).

Step-c

Figure 18C:
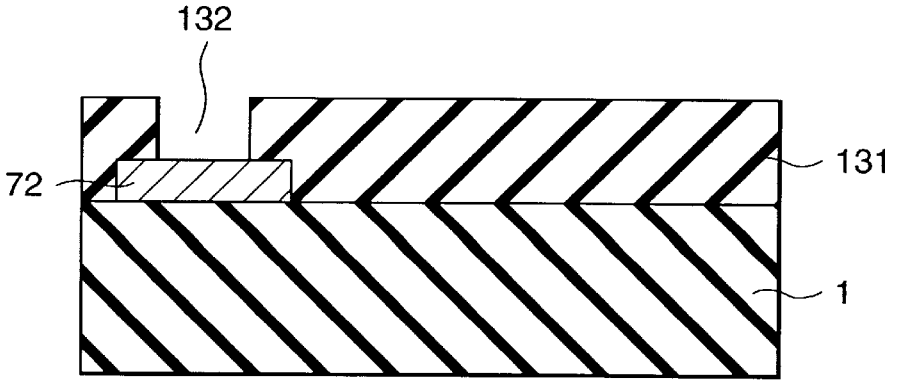

A photoresist pattern for forming the contact hole 132 was formed on the silicon oxide film deposited in step b, and the interlevel insulating layer 131 was etched using the photoresist pattern as a mask to form a contact hole 132. This etching was RIE (Reactive Ion Etching) using $CF_4$ and $H_2$ gases (FIG. 18C).

Step-d

Figure 18D:
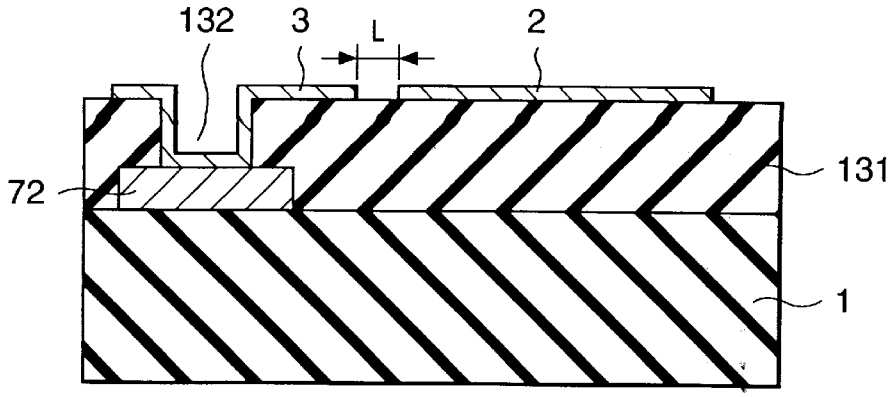

A pattern for the electrodes 2 and 3 and a gap L between the electrodes 2 and 3 was formed from a photoresist (RD-2000N available from Hitachi Chemical Co., Ltd.), and Ti and Pt were sequentially deposited by vacuum evaporation to thicknesses of 5 nm and 50 nm, respectively. The photoresist pattern was dissolved with an organic solvent to lift off the Pt/Ti deposition film, thereby forming electrodes 2 and 3 having an interval L of 10 μm and an electrode width W1 of 200 μm (FIG. 18D).

Step-e

Figure 19E:
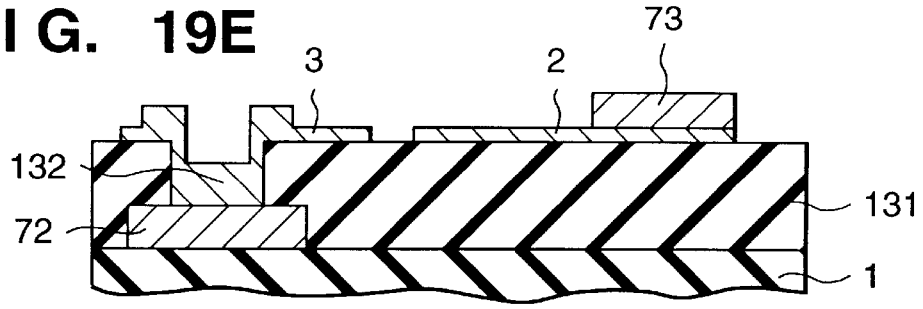
FIGS. 19E to 19H are sectional views for explaining the steps in manufacturing the electron source in FIG. 16.
Figure 19F:
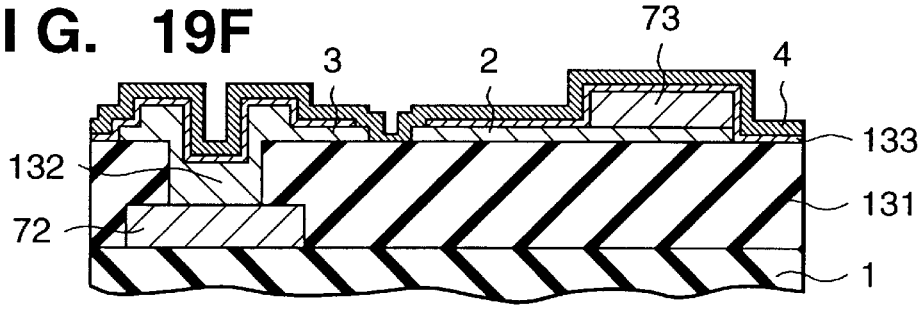

Ti and Au were sequentially deposited by vacuum evaporation to thicknesses of 5 nm and 1 μm, respectively. After a photoresist pattern for the upper wiring 73 was formed, unwanted Au and Ti portions were respectively removed by wet etching and dry etching, thereby forming an Au/Ti upper wiring 73 (FIG. 19E).

Step-f

A mask for the conductive film 4 of the electron-emitting device in this step had the gap L and an opening near the gap L. Using this mask, a 100-nm thick Cr film 133 was deposited and patterned by vacuum evaporation, spin-coated by a spinner with organic Pd (ccp4230 available from Okuno Seiyaku KK), and heated and sintered at 300° C. for 10 min (FIG. 19F) The conductive thin film 4 made of Pd as a main element had a thickness of 10 nm and a sheet resistance value of $5\times10^4$ Ω/□.

Step-g

Figure 19G:
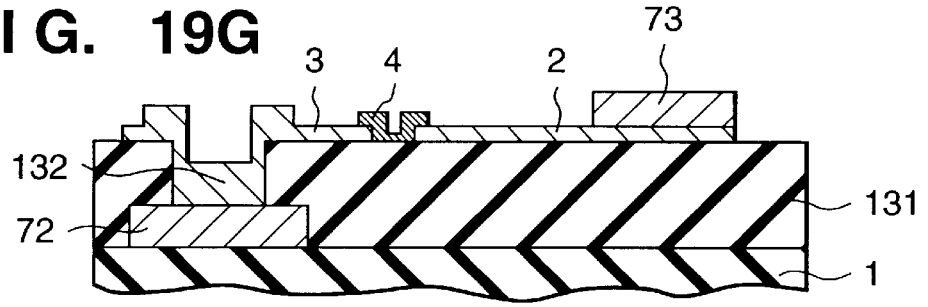

The Cr film 133 and sintered conductive thin film 4 were etched into a desired pattern with an acid etchant (FIG. 19G).

Step-h

Figure 19H:
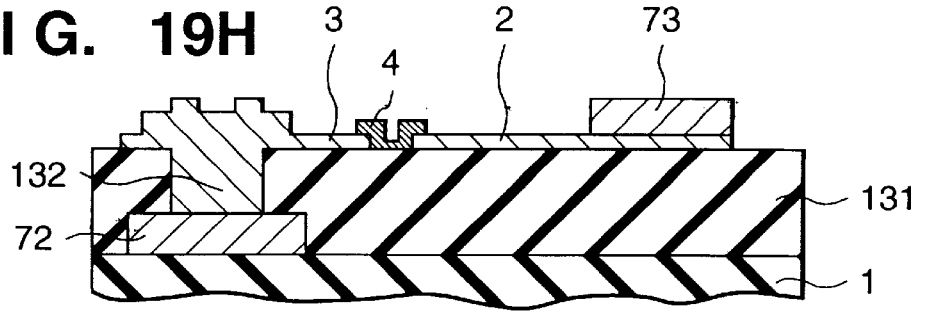

A resist was applied to the entire surface, exposed using a mask, and developed to remove the resist from only the contact hole 132. Thereafter, Ti and Au were sequentially deposited by vacuum evaporation to thicknesses of 5 nm and 1 μm, respectively. An unwanted portion was lifted off to fill the contact hole 132 (FIG. 19H).

These steps yielded the electron source substrate 71, before forming processing, constituted by connecting a plurality of conductive films by the lower and upper wirings 72 and 73 in a simple matrix on the insulating substrate 1.

Subsequently, an image forming apparatus (flat panel display) was manufactured using this electron source. The manufacturing procedure will be explained with reference to FIGS. 9, 10A, and 10B.

Step-i

A face plate 86 was formed as follows. An indium-tin oxide (ITO) thin film was sputtered on a cleaned glass substrate 83, and a fluorescent film 84 was formed by printing on the ITO thin film (not shown). As will be described later, this ITO thin film serves to apply a potential in order to extract electrons emitted by the electron-emitting device. The fluorescent film 84 was a fluorescent film shown in FIG. 10A on which stripes of fluorescent substances (R, G, and B) 92 and black conductive members (black stripes) 91 were alternately laid out. After the fluorescent film 84 was formed, smoothing processing (generally called filming) was done for the inner surface of the fluorescent film 84, and a metal back 85 of an Al thin film was sputtered to a thickness of 50 nm on the fluorescent film 84. By the following steps, the face plate 86 was formed.

Step-j

The electron source substrate 71 having many electron-emitting devices before forming processing was fixed as a rear plate 81. Then, the face plate 86 was set about 5 mm above the electron source substrate 71 via a support frame 82. Frit glass was applied to the joint portions between the face plate 86, support frame 82, and rear plate 81, and sintered in the atmosphere at 400° C. for 10 min to seal them. In sealing, fluorescent substances of the respective fluorescent substances and electron-emitting devices were aligned with high precision in order to accurately reproduce a color display.

Processing for the electron-emitting device and the like in the envelope will be explained.

Step-k

An envelope 88 completed by these steps was connected to an evacuation device like the one shown in FIG. 11 to evacuate the envelope 88 by a vacuum pump via an exhaust pipe 132.

Note that in FIG. 11, a display panel 101 is connected to a vacuum chamber 133 via the exhaust pipe 132, and the vacuum chamber 133 is connected to an exhaust device 135 via a gate valve 134. The vacuum chamber 133 is equipped with a pressure gauge 136 and quadruple-pole mass spectrometer (Q-MS) 137 in order to monitor the internal pressure and the partial pressure of each residual gas. Since it is difficult to directly measure the internal pressure of the envelope 88, the pressure of the vacuum chamber 133 and the partial pressure of gas are regarded as the inner pressure of the envelope (or partial pressure of gas). The exhaust device 135 is an ultra-high vacuum exhaust device made up of a sorption pump and ion pump. The vacuum chamber 133 is connected to a plurality of gas supply devices. FIG. 11 shows only one cylinder or ampule for storing a supply substance source 140, one gas supply control device (solenoid valve or the like) 139, and one gas supply line 138.

In practice, however, a plurality of gas supply paths can be ensured to supply a plurality of kinds of gases into the envelope. The gas supply control means 139 is a solenoid valve, needle valve, mass-flow controller, or slow leak valve in accordance with the kind of supply substance, flow rate, necessary control precision, and the like.

After the envelope 88 was evacuated to a sufficient vacuum degree by the exhaust device 135, the voltage was applied between the electrodes 2 and 3 of each electron-emitting device 74 via the outer terminals Dxo1 to Dxom and Doy1 to Doyn to flow a current through the conductive film 4. By this step, a gap 6 was formed at part of the conductive film 4 (forming processing was done). The voltage waveform of forming processing was a rectangular pulse as shown in FIG. 4B whose peak value was gradually increased. In this Example 3, T1 and T2 were 1 msec and 10 msec, respectively. A rectangular pulse having a peak value of 0.1 V was inserted in a triangular pulse, and the current was measured to measure the resistance of a selected line. When the resistance value exceeded 1 MΩ per device, forming processing for the selected line was completed, and the same processing was done for the next line. By this procedure, forming processing was performed for all the lines (i.e., electron-emitting devices).

Step-l

Acetone was supplied from the supply substance source 140 into the envelope via a slow leak valve, and kept at $1.3\times10^{-3}$ [Pa]. Similar to Example 1, a rectangular pulse having a peak value of 15 V was applied to a selected line. In Example 3, while the device current If was measured, activation processing was done. In this fashion, forming processing and activation processing were performed to manufacture an electron source substrate.

Step-m

Then, stabilization processing was done. In this stabilization processing, the envelope 88 was evacuated while being heated at about 200° C. for 2 h.

Step-n

The exhaust pipe was heated and fused by a gas burner to seal the envelope.

Finally, to more reliably maintain the vacuum degree after sealing, a Ba getter attached outside the image display region on the face plate 86 was evaporated by RF heating.

In the completed image display apparatus of Example 3, a signal generation means (not shown) supplied a scan signal to respective electron-emitting devices via the outer terminals Dx1 to Dxm, and a modulation signal to respective electron-emitting devices via the outer terminals Dy1 to Dyn, thereby emitting electrons.

At the same time, a high voltage of several kV or more was applied to the metal back 85 or transparent electrode (ITO) via a high-voltage terminal Hv to accelerate the emitted electrons. The accelerated electrons collided against the fluorescent film 84 to excite it and emit light, thereby forming an image.

The driving method of Example 3 was executed.

The peak value of the voltage pulse applied to each electron-emitting device was set to 15 V, all the electron-emitting device lines connected to the outer terminals Dx1 to Dxm were sequentially driven to sequentially drive all the devices, and the maximum value of the emission current was measured. The peak value was changed to 14 V to measure the maximum value of the emission current (first measurement step). The maximum value was about 40% that for a peak value of 15 V on each line. Therefore, when a pulse having a peak value of 15 V was applied, the pulse width was set about 40% that for a peak value of 14 V. With this setting, charges captured by the anode electrode per unit time were confirmed to be almost equal to charges captured when the peak value was 14 V. The characteristics were evaluated for 300 h.

In Example 3, the pulse waveform was rectangular, the peak value of the driving voltage Vf was basically kept at 14 V, and gradation display was realized by changing the pulse width. An increase in emission current Ie was monitored by an emission current monitoring controller 58. When an emission current increase of 3% or more at maximum was detected, one pulse having a voltage peak value of 15 V was applied to the device instead of a pulse having a driving voltage Vf peak value of 14 V (characteristic recovery driving). The pulse width for a peak value of 15 V was 40% that for a peak value of 14 V. Accordingly, characteristic recovery driving could be executed without any luminance variations in displayed image. The emission current Ie was measured when the pulse having a peak value of 14 V was applied.

The 300-h characteristic evaluation revealed that a high-quality image almost free from time changes in emission current was displayed.

Example 4

In Example 4, a flat panel display was manufactured. A display panel 101 constituting the flat panel display of Example 4 was prepared similarly to Example 3 (step-a to step-n) (FIG. 9).

Figure 23:
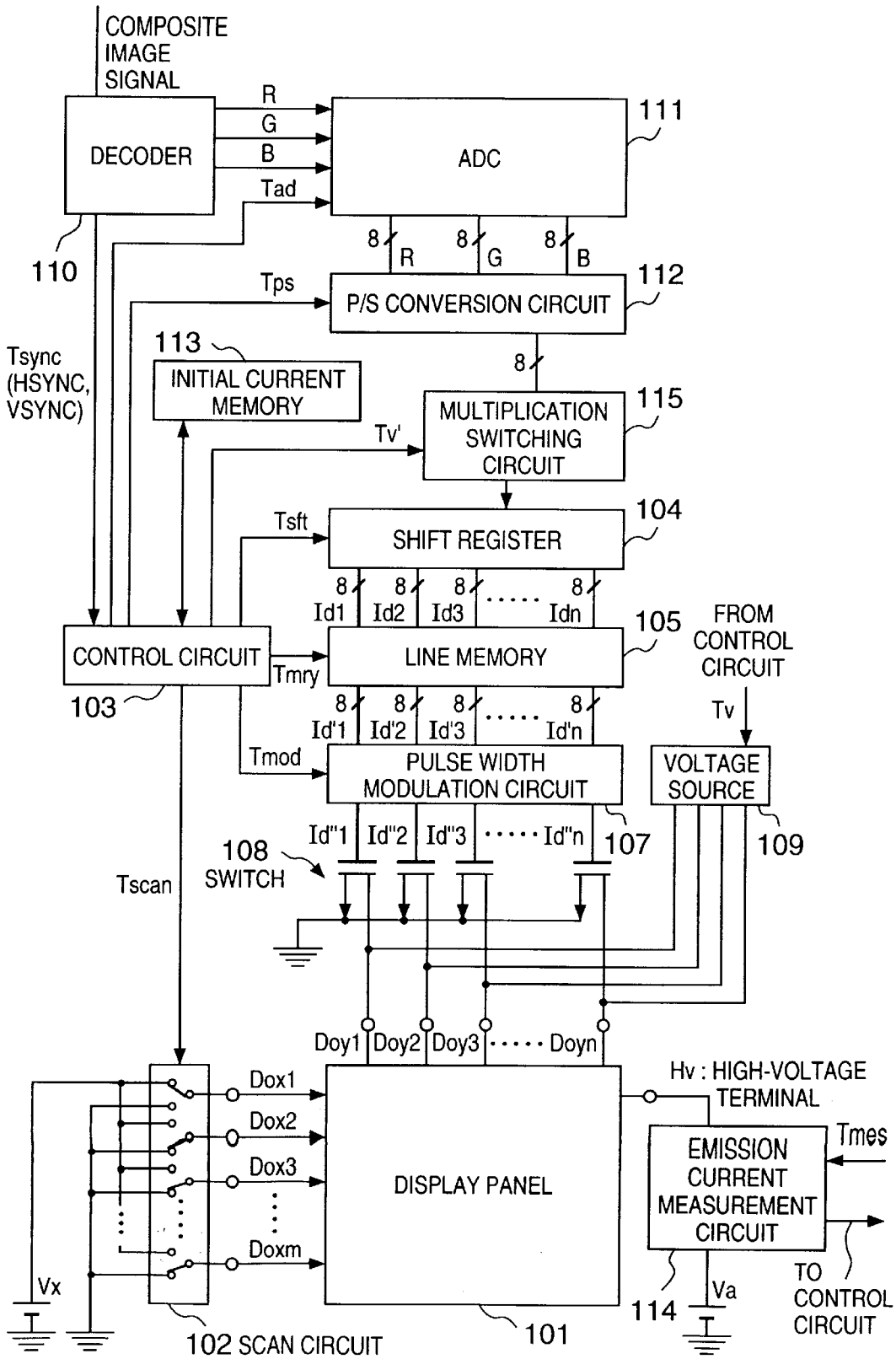
FIG. 23 is a block diagram showing an example of the driving circuit of an image forming apparatus according to the present invention.

The driving method of Example 4 will be described. FIG. 23 shows a driving circuit in Example 4. In FIG. 23, the same reference numerals denote the same parts of the basic driving circuit shown in FIG. 13.

In FIG. 23, the display panel 101 is connected to an external electric circuit via terminals Dox1 to Doxm and Doy1 to Doyn. A high-voltage terminal Hv on a face plate is connected to an external high-voltage power supply Va. The terminals Dox1 to Doxm receive scan signals for sequentially driving a multi electron source incorporated in the panel, i.e., electron-emitting devices laid out in a m×n matrix in units of lines. The terminals Dy1 to Dyn receive modulation signals for controlling electron beams output from the electron-emitting devices on one line selected by the scan signals.

The scan circuit 102 will be described next. This circuit incorporates m switching devices. Each switching device selects either an output voltage from a DC voltage source Vx or 0 V (ground level) and is electrically connected to a corresponding one of the terminals Dox1 to Doxm of the display panel 101. The switching device operates based on a control signal Tscan output from a control circuit 103. In practice, the scan circuit 102 can be easily constituted by a combination of switching devices such as FETs.

In Example 4, the DC voltage source Vx outputs a constant voltage of 7 V such that the driving voltage to be applied to a device not scanned becomes equal to or lower than the electron-emitting threshold voltage (in practice, the electron-emitting threshold voltage Vth was 8 V) on the basis of the characteristics of the surface-conduction type electron-emitting device shown in FIG. 6.

The flow of an input image signal will be explained.

An input composite image signal is separated by a decoder 110 into luminance signals of three primary colors, and horizontal and vertical sync signals (to be referred to as a sync signal TSYNC for descriptive convenience) The control circuit 103 matches the operations of respective components with each other so as to perform proper display based on an externally input image signal. The control circuit 103 generates control signals Tad, Tps, Tscan, Tsft, Tmry, Tmod, Tv', Tv, and Tmes for respective components on the basis of Tsync.

The luminance signals of three primary colors are input to an ADC (analog-to-digital converter) 111 where the signals are converted into 8-bit digital signals at the timing of the sampling clock Tad. The number of bits at this time is determined in accordance with the number of gray levels (number of colors) necessary for a display image. In Example 4, the number of bits is determined to 8 in order to realize 256 gray levels (about 16,700,000 colors) for each of R, G, and B colors. The converted digital luminance signals are input to a P/S (parallel-to-serial) conversion circuit 112 in order to rearrange them in accordance with the pixel layout on the face plate. The serial-converted data (8 bits) is input to a shift register 104 via a multiplication switching circuit 115. This multiplication switching circuit will be described below.

The shift register 104 serial/parallel-converts in units of lines of an image the digital signals serially input in a time-series manner. The shift register 104 operates based on the control signal Tsft sent from the control circuit 103 (i.e., the control signal Tsft is a shift clock for the shift register 104.) Serial/parallel-converted 1-line image data (corresponding to driving data for N electron-emitting devices) is output as N parallel signals Id1 to Idn from the shift register 104.

The line memory 105 stores 1-line image data for a necessary period of time. The line memory 105 properly stores the contents of the signals Id1 to Idn in accordance with the control signal Tmry sent from the control circuit 103. The stored contents are output as I'd1 to I'dn to a pulse width modulation circuit 107.

Figure 24:
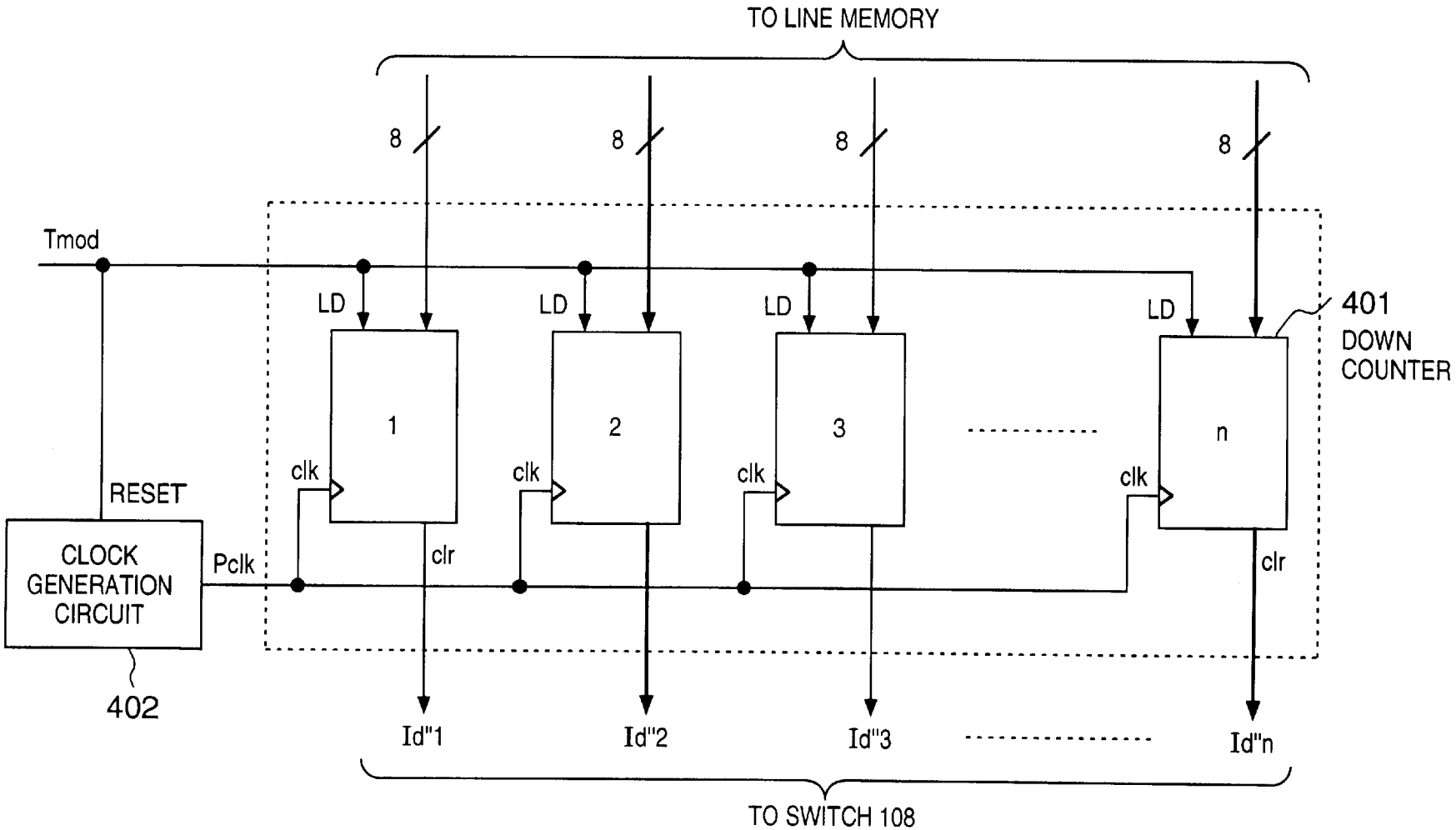
FIG. 24 is a block diagram showing an example of a pulse width modulation circuit.

The pulse width modulation circuit 107 generates a pulse having a time width corresponding to each of the image data Id'n to Id'n. The outputs of the pulse width modulation circuit 107 are connected to the gates of switches 108 via terminals Id"1 to Id"n. The pulse width modulation circuit 107 outputs a voltage signal having a pulse width corresponding to data in synchronism with the timing signal Tmod from the control circuit 103. The internal arrangement of the pulse width modulation circuit 107 will be explained with reference to FIG. 24. Reference numerals 401 denote n down counters aligned corresponding to the number of column wirings. The data input terminals of the down counters 401 are respectively connected to the data lines Id'1 to Id'n extending from the line memory 105. Data load terminals LD are commonly connected to the signal Tmod from the control circuit to load countdown data from Id'1 to Id'n in synchronism with the timing of Tmod. The counter clocks clk are also commonly connected to a clock output Pclk of an inner countdown clock generation circuit 402. The clock of the clock generation circuit 402 is reset an d generated in response to Tmod. The frequency of Pclk must be equal to or higher than an integer multiple (256 for the 8-bit counter in Example 4) of the count value of the signal Tmod counter, and is set 260 times the count value in consideration of the selection switching time in Example 4. By this setting, simultaneously when data is loaded at the timing of Tmod, the down counter 401 starts counting down in response to the counter clock Pclk. When the count value reaches 0, a signal clr becomes true (5 V). This signal switches the output of the voltage source by the gate terminal of the switch 108. Thus, application of the voltage to a column wiring corresponding to this time is stopped to realize pulse width modulation.

A voltage source 109 outputs a peak value for performing pulse width modulation. In Example 4, the voltage source 109 can switch and output two voltage values in response to the switching signal Tv from the control circuit 103, as will be described later.

An initial current memory 113 stores an initial emission current Ie, as will be described later. The control circuit 103 reads out and writes values for m rows from and in the initial current memory 113.

An emission current measurement circuit 114 measures the emission current of each scan line in response to the measurement timing Tmes output from the control circuit 103, and transmits a measurement value as a digital value to the control circuit 103.

Figure 25:
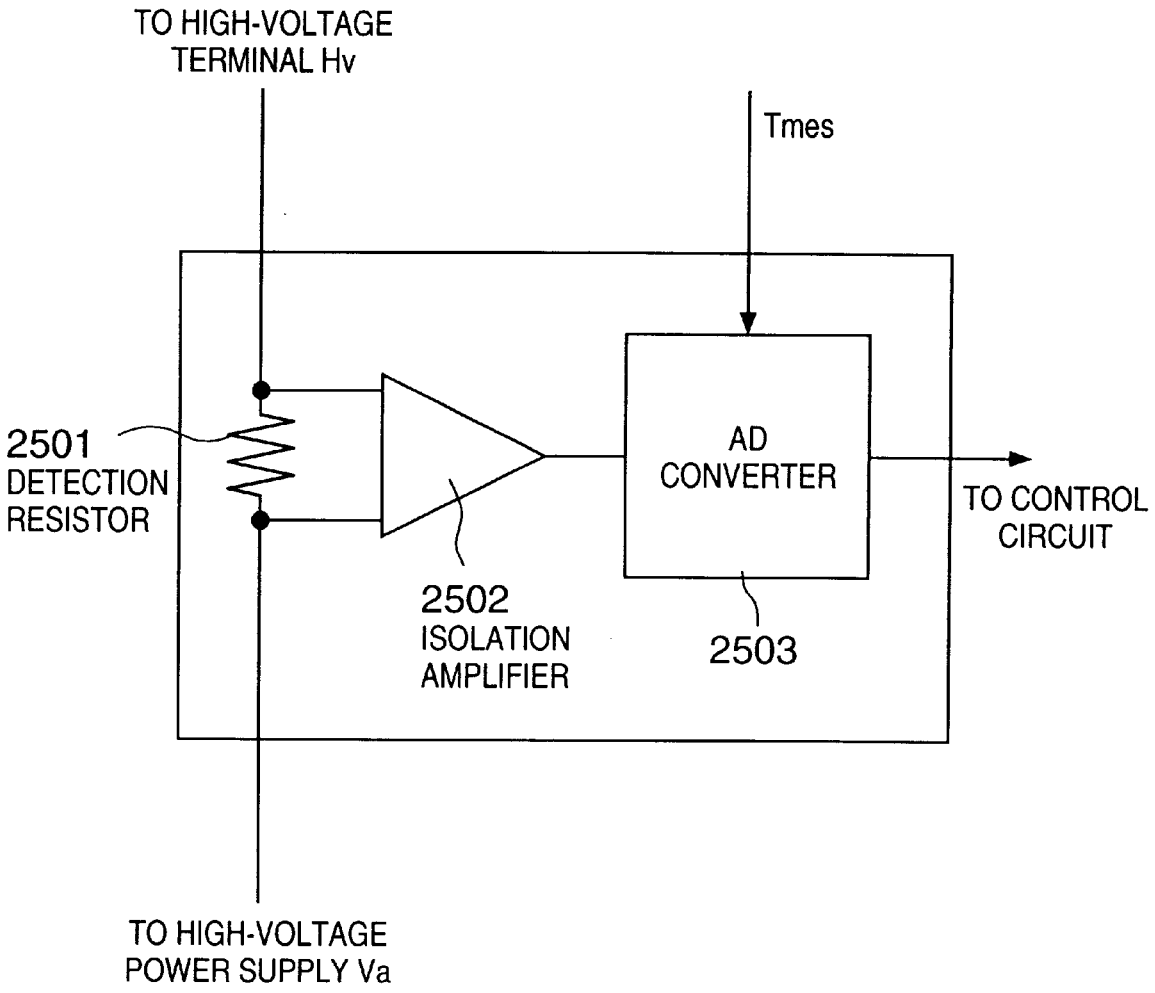
FIG. 25 is a block diagram showing an example of a circuit for measuring the emission current.

FIG. 25 shows the arrangement of the emission current measurement circuit.

In FIG. 25, reference numeral 2501 denotes a detection resistor for generating a potential in accordance with a current flowing between the high-voltage power supply Va and high-voltage terminal Hv; and 2502, an isolation amplifier for amplifying the voltage across the detection resistor 2501 with a proper gain, and isolating a high voltage so as not to be directly applied to an A/D converter and control circuit. An analog current value isolated from the high voltage is input to an A/D converter 2503, A/D-converted in synchronism with the timing of Tmes, and output to the control circuit.

Operation of each constituent component of the driving circuit has been described. Next, the method in Example 4 will be explained.

The peak value of the voltage pulse applied to each electron-emitting device was set to 15 V, the lines of electron-emitting devices connected to the outer terminals Dox1 to Doxm were sequentially driven to sequentially drive all the devices, and the maximum value of the emission current was measured.

This measurement can be done using the driving circuit shown in FIG. 23. The voltage source 109 normally outputs −7 V to the column wirings Doy1 to Doyn. In 15V measurement, the voltage source 109 switches the voltage value to −8 V to increase the device application voltage from the normal voltage of 14 V (device driving voltage Vf).

Figure 26:
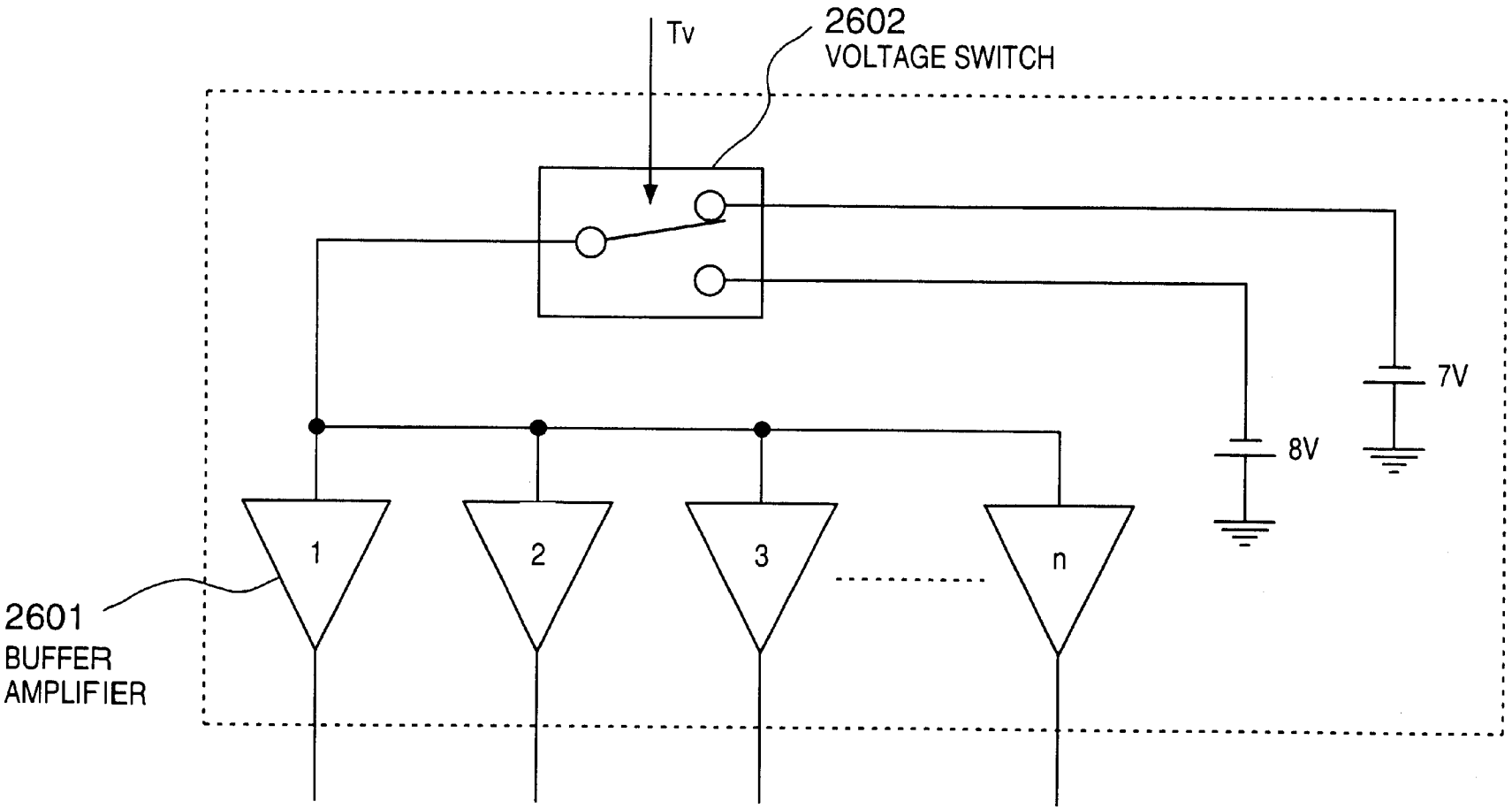
FIG. 26 is a block diagram showing an example of the arrangement of a voltage source.

FIG. 26 shows the arrangement of the voltage source 109 for realizing this.

Reference numerals 2601 denote buffer amplifiers connected to corresponding column wirings. Each buffer amplifier 2601 directly outputs a voltage equal to an input voltage, and can output a current necessary to drive each device. When the switch 108 is switched to ground, the buffer amplifier 2601 limits the current so as not to heat the device. More specifically, the buffer amplifier 2601 is formed from an operational amplifier or the like. The inputs of the buffer amplifiers on respective columns are short-circuited and connected to a voltage switch 2602.

The voltage switch 2602 is controlled by the signal Tv from the control circuit 103. The buffer amplifier 2601 is normally connected to the power supply of −7 V. In 15V measurement, the voltage switch 2602 is connected to the power supply of −8 V. Since the scan circuit power supply Vx is set to 7 V, as described above, the device application voltage changes to 15 V. The control circuit 103 measures the emission current of each scan line at this time using the emission current measurement circuit 114, and temporarily stores the measurement value in the initial current memory 113.

The peak value was changed to 14 V (in Example 4, the output voltage of the voltage source 109 was returned to −7 V). The maximum value of the emission current was measured similarly to the above-described examples, and compared with the 15V measured value to find that the maximum value was about 40% that for a peak value of 15 V on each line. Therefore, when a pulse having a peak value of 15 V was applied, the pulse width was set about 40% that for a peak value of 14 V. Charges captured by the anode electrode per unit time were confirmed to be almost equal to charges captured when the peak value was 14 V.

The 14V measured value was stored in the initial current memory 113 as an emission current value supposed to be measure (first measurement step).

As described above, in Example 4, the initial emission current value was measured directly using the actual driving circuit. Alternatively, a dedicated inspection device may be used to measure the initial emission current value, and the measured value may be written in the memory of the driving circuit.

After that, an image was actually displayed.

In Example 4, the driving pulse waveform was rectangular, the peak value of the driving voltage Vf was basically kept at 14 V, and gradation display was realized by changing the pulse width (pulse width modulation).

Figure 27:
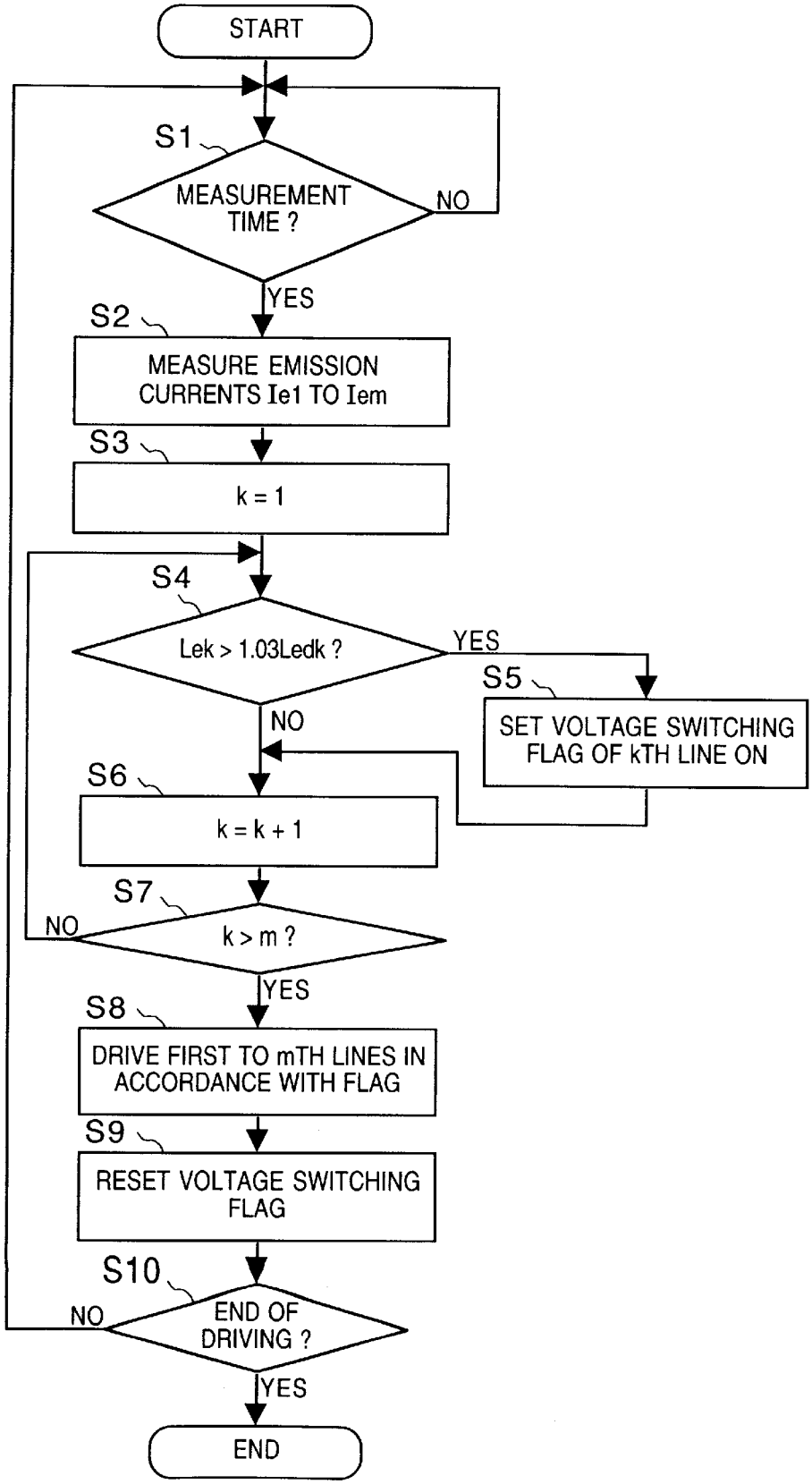
FIG. 27 is a flow chart showing an example of a driving method according to the present invention.

Operation in actual display driving will be explained with reference to the flow chart shown in FIG. 27.

At the start of driving, the flow enters a time wait loop until the emission current measurement time (S1).

At the measurement time, emission currents Ie1 to Iem of respective scan lines are measured (S2: second measurement step).

After completion of measurement, the counter k of a current comparison loop is reset to 1 (S3), and the emission current value Iek of each line is compared with the initial emission current Iedk stored in the initial current memory 113. In Example 4, the emission current value Iek was compared with a value 3% higher than Iedk in order to prevent measurement variations and excessively high Vf driving (S4).

If Iek is higher than the value 3% higher than Iedk (YES in S4), the voltage switching flag of the kth line is set ON (S5).

The counter value is incremented, and if k exceeds m, current comparison is determined to be completed (S6).

If k does not exceed m, the current value is kept compared (S7).

If comparison is completed, driving is done in accordance with the voltage switching flag in the next frame driving (S8: characteristic recovery driving). More specifically, the control circuit 103 checks the voltage switching flag every driving scan line, and if the flag is ON, switches the multiplication switching circuit by the signal Tv' to output the product of data from the P/S conversion circuit 112 by 0.4 to the shift register 104. The multiplication switching circuit 115 directly outputs data from the P/S converter in normal driving, and only when receiving the signal Tv', outputs 0.4-time data. At the same time, the control circuit 103 switches the voltage of the voltage source 109 to −8 V by the signal Tv. Even if the device is driven by increasing the driving voltage by this operation, characteristic recovery driving can be achieved by decreasing the pulse width without impairing desired gradation.

After driving corresponding to the voltage switching flag is performed for only one frame, the flag is reset (S9) If driving is not completed, the flow returns to normal driving to enter the measurement wait loop.

This driving could realize a high-quality image almost free from luminance variations and deterioration after long-time driving.

As has been described above, the present invention can effectively suppress variations in device characteristics such as increases in emission current and device current during long-time driving owing to unsatisfactory removal of an organic substance and the like. The emission current and device current can be stabilized for a long time.

At the same time, deterioration in device characteristics can be minimized by applying the voltage V2 higher than the driving voltage Vf, as needed.

As has been described above, the present invention can prevent deterioration in electron-emitting characteristics of the electron-emitting device. In addition, the present invention can suppress variations in device current or emission current characteristic with respect to a predetermined application voltage to the electron-emitting device, thereby maintaining stable electron-emitting characteristics for a long time.

As many apparently widely different embodiments of the present invention can be made without departing from the spirit and scope thereof, it is to be understood that the invention is not limited to the specific embodiments thereof except as defined in the appended claims.

What is claimed is:

1. A method of driving an electron-emitting device, comprising the steps of:

a first measurement step of measuring at least one of an emission current (Ie1) emitted by the electron-emitting device and a device current (If1) flowing through the electron-emitting device, when a voltage (V1) is applied to the electron-emitting device;

a second measurement step of measuring at least one of an emission current (Ie2) emitted by the electron-emitting device and a device current (If2) flowing through the electron-emitting device, when the voltage (V1) is applied to the electron-emitting device after said first measurement step; and a voltage application step of applying a voltage (V2) higher than the voltage (V1) to the electron-emitting device, in a case where at least one of the emission current (Ie2) and the device current (If2) is larger than the emission current (Ie1) and the device current (If1), respectively, wherein in said voltage application step, the voltage (V2) is applied so that at least one of the emission current (Ie2) and the device current (If2) becomes closer to the emission current (Ie1) and device current (If1), respectively, of the electron-emitting device.

2. The method according to claim 1, wherein said first measurement step, said second measurement step, and said voltage application step are repeated after said voltage application step has been performed.

3. The method according to claim 1, wherein the voltage (V2) applied in said voltage application step is not higher than a predetermined maximum voltage value (Vmax) applied to the electron-emitting device prior to the performance of said first measurement step.

4. The method according to claim 1, wherein at least one of the voltages (V1) and (V2) applied to the electron-emitting device is a pulse-like voltage.

5. A method of driving an electron-emitting device, comprising the steps of:

a first measurement step of measuring at least one of an emission current (Ie1) emitted by the electron-emitting device and a device current (If1) flowing through the electron-emitting device, when a pulse-like voltage is applied to the electron-emitting device;

a second measurement step of measuring at least one of a current (Ie2) emitted by the electron-emitting device and a device current (If2) flowing through the electron-emitting device, when the same waveform as a waveform of the pulse-like voltage is applied to the electron-emitting device after said first measurement step; and a voltage application step of applying to the electron-emitting device a pulse-like voltage having a power larger than a power of the pulse-like voltage applied in said first measurement step, when at least one of the current (Ie2) and device current (If2) is larger than the emission current (Ie1) and device current (If1), respectively, wherein in said voltage application step, the pulse-like voltage is applied so that at least one of the current (Ie2) and device current (If2) of the electron-emitting device becomes closer to the emission current (Ie1) and device current (If1), respectively, of the electron-emitting device.

6. The method according to claim 5, wherein a maximum voltage value among pulses applied in said voltage application step is larger than a maximum voltage value among pulses applied in said first measurement step.

7. The method according to claim 5, wherein said first measurement step, said second measurement step, and said voltage application step are repeated after said voltage application step has been performed.

8. The method according to claim 5, wherein a power of a pulse applied in said voltage application step is not larger than a predetermined maximum power applied to the electron-emitting device prior to the performance of said first measurement step.

9. A method of driving an electron source obtained by arranging a plurality of electron-emitting devices, wherein the electron-emitting devices are driven by a method comprising the steps of:

a first measurement step of measuring at least one of an emission current (Ie1) emitted by the electron-emitting device and a device current (If1) flowing through the electron-emitting device, when a pulse-like voltage is applied to the electron-emitting device;

a second measurement step of measuring at least one of a current (Ie2) emitted by the electron-emitting device and a device current (If2) flowing through the electron-emitting device, when the same waveform as a waveform of the pulse-like voltage is applied to the electron-emitting device after said first measurement step; and a voltage application step of applying to the electron-emitting device a pulse-like voltage having a power larger than a power of the pulse-like voltage applied in said first measurement step, when at least one of the current (Ie2) and device current (If2) is larder than the emission current (Ie1) and device current (If1), respectively, wherein in said voltage application step, the pulse-like voltage is applied so that at least one of the current (Ie2) and device current (If2) of the electron-emitting device becomes closer to the emission current (Ie1) and device current (If1), respectively, of the electron-emitting device.

10. A method of driving an image forming apparatus comprising an electron source and an image forming member, wherein the electron source is obtained by arranging a plurality of electron-emitting devices, wherein the electron-emitting devices are driven by a method comprising the steps of:

a first measurement step of measuring at least one of an emission current (Ie1) emitted by the electron-emitting device and a device current (If1) flowing through the electron-emitting device, when a pulse-like voltage is applied to the electron-emitting device;

a second measurement step of measuring at least one of a current (Ie2) emitted by the electron-emitting device and a device current (If2) flowing through the electron-emitting device, when the same waveform as a waveform of the pulse-like voltage is applied to the electron-emitting device after said first measurement step; and a voltage application step of applying to the electron-emitting device a pulse-like voltage having a power larger than a power of the pulse-like voltage applied in said first measurement step, when at least one of the current (Ie2) and device current (If2) is larger than the emission current (Ie1) and device current (If1), respectively, wherein in said voltage application step, the pulse-like voltage is applied so that at least one of the current (Ie2) and device current (If2) of the electron-emitting device becomes closer to the emission current (Ie1) and device current (If1), respectively, of the electron-emitting device.

* * * * *

UNITED STATES PATENT AND TRADEMARK OFFICE

CERTIFICATE OF CORRECTION

PATENT NO. : 6,225,749 B1
DATED : May 1, 2001
INVENTOR(S) : Tamaki Kobayashi et al.

It is certified that error appears in the above-identified patent and that said Letters Patent is hereby corrected as shown below:

Column 1,
Line 47, "recently replacing" should read -- recently been replacing --;
Line 47, "a" should read -- an --;
Line 67, "is flowed" should read -- flows --.

Column 3,
Line 28, "acteristic" should read -- acteristics --;
Line 50, "may-be" should read -- may be --;
Line 55, "maybe" should read -- may be --;
Line 63, "characteristic" should read -- characteristics --.

Column 4,
Line 6, "characteristic" should read -- characteristics --;
Line 21, "comprising" should read -- comprising: --.

Column 10,
Line 65, "structure.)" should read -- structure) --.

Column 11,
Line 13, "coil" should read -- oil --.

Column 12,
Line 52, "or the forming step" should be deleted.

Column 19,
Line 56, "heat" should read -- heated --.

Column 22,
Line 53, "which" should be deleted.

Column 25,
Line 20, "every" should be deleted.

UNITED STATES PATENT AND TRADEMARK OFFICE

CERTIFICATE OF CORRECTION

PATENT NO. : 6,225,749 B1
DATED : May 1, 2001
INVENTOR(S) : Tamaki Kobayashi et al.

It is certified that error appears in the above-identified patent and that said Letters Patent is hereby corrected as shown below:

Column 26,
Line 52, "Th" should read -- The --.

Column 31,
Line 58, "an d" should read -- and --.

Column 36,
Line 11, "larder" should read -- larger --.

Signed and Sealed this

Twenty-sixth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,225,749 B1
DATED : July 3, 2001
INVENTOR(S) : Chikara Aoshima et al.

It is certified that error appears in the above-identified patent and that said Letters Patent is hereby corrected as shown below:

Column 1,
Line 36, “106a 1” should read -- 106a1 --.

Column 2,
Line 43, “vies” should read -- view --.
Line 55, “FIGS.” should read -- to FIGS. --.

Column 3,
Line 39, “numerals” should read -- numeral --.
Line 60, “numerals” should read -- numeral --.

Column 4,
Line 53, “said” should read -- the --.
Line 54, “coil” should read -- the coil -- (second occurrence).

Column 6,
Line 16, “prevented to minimum,” should read -- prevented or minimized --.
Line 33, “said” should read -- the --.
Line 35, “coil” should read -- the coil --.
Line 43, “motor.” should read -- the motor. --.
Line 46, “is” should read -- are --.

Column 7,
Line 20, “18d,” should read -- 19d, --.
Line 32, “18d,” should read -- 19d, --.
Line 44, “18d,” should read -- 19d, --.

Column 8,
Line 58, “case of,” should read -- case thereof --.

Column 9,
Line 11, “step” should read -- a step --.
Line 24, “described-above” should read -- above-described --.

UNITED STATES PATENT AND TRADEMARK OFFICE

CERTIFICATE OF CORRECTION

PATENT NO. : 6,225,749 B1
DATED : July 3, 2001
INVENTOR(S) : Chikara Aoshima et al.

It is certified that error appears in the above-identified patent and that said Letters Patent is hereby corrected as shown below:

Column 10,
Line 21, “a end” should read -- an end --.

Column 11,
Line 11, “hollow-shape” should read -- hollow-shaped --.
Line 58, “rotar” should read -- rotary --.

Column 12,
Line 32, “hollow-shape” should read -- hollow-shaped --.

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,225,749 B1
DATED : May 1, 2001
INVENTOR(S) : Tamaki Kobayashi et al.

It is certified that error appears in the above-identified patent and that said Letters Patent is hereby corrected as shown below:

This certificate supersedes Certificate of Correction issued October 22, 2002, the number was erroneously mentioned and shoud be deleted since no Certificate of Correction was granted.

Signed and Sealed this

Seventeenth Day of December, 2002

JAMES E. ROGAN
*Director of the United States Patent and Trademark Office*